US005429917A

United States Patent [19]

Mihayashi et al.

[11] Patent Number: 5,429,917

[45] Date of Patent: * Jul. 4, 1995

[54] SILVER HALIDE COLOR PHOTOGRAPHIC MATERIAL COMPRISING A HIGH SILVER IODIDE CONTAINING SILVER HALIDE EMULSION AND A COUPLER

[75] Inventors: Keiji Mihayashi; Naoki Saito; Seiji Ichijima, all of Kanagawa, Japan

[73] Assignee: Fuji Photo Film Co., Ltd., Kanagawa, Japan

[ * ] Notice: The portion of the term of this patent subsequent to May 25, 2010 has been disclaimed.

[21] Appl. No.: 250,117

[22] Filed: May 26, 1994

Related U.S. Application Data

[63] Continuation of Ser. No. 831,815, Feb. 6, 1992, abandoned.

[30] Foreign Application Priority Data

Feb. 8, 1991 [JP] Japan ..... 3-039407

[51] Int. Cl.[6] ..... G03C 7/36; G03C 1/005

[52] U.S. Cl. ..... 430/544; 430/556; 430/557; 430/567

[58] Field of Search ..... 430/556, 557, 558, 567, 430/544

[56] References Cited

U.S. PATENT DOCUMENTS

| | | | |
|---|---|---|---|
| 4,149,886 | 4/1979 | Tanaka et al. | 430/556 |
| 4,579,816 | 4/1986 | Ohlschlager et al. | 430/544 |
| 4,668,614 | 5/1987 | Takada et al. | 430/567 |
| 5,006,452 | 4/1991 | Bucci | 430/544 |
| 5,213,958 | 5/1993 | Motoki et al. | 430/557 |

FOREIGN PATENT DOCUMENTS

| | | |
|---|---|---|
| 0337370 | 10/1989 | European Pat. Off. . |
| 4447920 | 9/1991 | European Pat. Off. . |
| 1204680 | 9/1970 | United Kingdom . |

*Primary Examiner*—Lee C. Wright

*Attorney, Agent, or Firm*—Birch, Stewart, Kolasch & Birch

[57] ABSTRACT

A silver halide color photographic material is disclosed. The photographic material comprises a support having provided thereon at least one light-sensitive emulsion layer containing a coupler represented by the general formula (I) and/or a coupler represented by the general formula (II), silver iodobromide containing 15 to 45 mol % silver iodide in a definite layer structure in the emulsion layer, and chemically sensitized silver halide grains having a total silver iodide content of more than 7 mol %:

(I)

(II)

wherein $X^1$ and $X^2$ each represents an alkyl group, an aryl group or a heterocyclic group; $X^3$ represents an organic residue which forms a nitrogen-containing heterocyclic group together with >N—; Y represents an aryl group or a heterocyclic group; and Z represents a group capable of being separated from the coupler upon the reaction of the coupler with the oxidation product of a developing agent.

14 Claims, No Drawings

SILVER HALIDE COLOR PHOTOGRAPHIC MATERIAL COMPRISING A HIGH SILVER IODIDE CONTAINING SILVER HALIDE EMULSION AND A COUPLER

This application is a continuation of application Ser. No. 07/831,815 filed on Feb. 6, 1992, now abandoned.

FIELD OF THE INVENTION

The present invention relates to a silver halide color photographic material. More particularly, the present invention relates to a silver halide color photographic material which comprises a high silver iodide content silver halide emulsion and a novel coupler and thus exhibits a high sensitivity, an excellent graininess, a reduced fluctuation in the photographic properties during storage, an excellent color reproducibility and an excellent dye image preservability after processing.

BACKGROUND OF THE INVENTION

In silver halide color photographic materials, particularly color photographic materials for picture taking, a light-sensitive material which exhibits a high sensitivity, an excellent graininess, an excellent color reproducibility, an excellent sharpness, a reduced fluctuation in the photographic properties during storage, and an excellent image preservability after processing has been desired.

Known types of yellow couplers for forming color photographic images include commonly known acyl acetanilide type couplers containing an active methylene (methine) group as disclosed in T. H. James, "The Theory of the Photographic Process", 4th ed., pp. 354–356. These dyes are disadvantageous in that they exhibit a low color density as well as a low dye forming rate. In particular, if these couplers are used as so-called DIR couplers, they must be used in a large amount because of their low activity, causing problems of dye stability, hue, cost, etc.

Malondianilide type couplers include those known couplers disclosed in U.S. Pat. Nos. 4,149,886, 4,095,984, and 4,477,563, and British Patent 1,204,680. However, these couplers are disadvantageous in that they exhibit a low image preservability, particularly a low fastness to heat and moisture. In their spectral absorption, azomethine dyes produced from these couplers have a skirt on the long wavelength side of yellow. Thus, it has been desired to improve these couplers for better color reproducibility.

Further, a light-sensitive material which comprises a definite layer structure containing a high silver iodide content silver iodobromide and contains high average silver iodide content silver halide grains is proposed in JP-A-60-143331, JP-A-1-186938, JP-A-1-269935 and JP-A-2-28637 (the term "JP-A" as used herein means an "unexamined published Japanese patent application"). This proposal can provide a light-sensitive material which exhibits a high sensitivity and an excellent graininess. However, when combined with conventional yellow couplers, the light-sensitive material has some difficulty in image preservability after processing and in color reproducibility.

SUMMARY OF THE INVENTION

An object of the present invention is therefore to provide a light-sensitive material which exhibits a high sensitivity, an excellent graininess, an excellent color reproducibility and an excellent sharpness.

Another object of the present invention is to provide a light-sensitive material which exhibits an excellent yellow image preservability.

A further object of the present invention is to provide a light-sensitive material which exhibits a reduced fluctuation in the photographic properties during storage.

A still further object of the present invention is to provide a light-sensitive material which comprises an emulsion with an excellent graininess and a small amount of a highly active yellow coupler to attain a low cost and provide an excellent image quality.

These and other objects of the present invention will become more apparent from the following detailed description and examples.

These objects of the present invention are accomplished with a silver halide color photographic material comprising a support having provided thereon at least one light-sensitive emulsion layer containing a coupler selected from the group consisting of a coupler represented by the general formula (I), a coupler represented by the general formula (II) and combinations thereof, silver iodobromide containing 15 to 45 mol % silver iodide in a definite layer structure in said emulsion layer, and chemically sensitized silver halide grains having a total silver iodide content of more than 7 mol %:

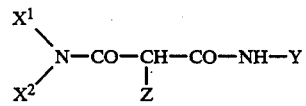

(I)

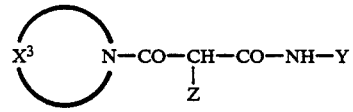

(II)

wherein $X^1$ and $X^2$ each represents an alkyl group, an aryl group or a heterocyclic group; $X^3$ represents an organic group which forms a nitrogen-containing heterocyclic group together with >N—; Y represents an aryl group or a heterocyclic group; and Z represents a group capable of being released from the coupler upon the reaction of the coupler with the oxidation product of a developing agent.

DETAILED DESCRIPTION OF THE INVENTION

The couplers represented by the general formulae (I) and (II) will be further described hereinafter.

The alkyl group represented by $X^1$ or $X^2$ is a $C_{1-30}$, preferably $C_{1-20}$ straight-chain, branched or cyclic, saturated or unsaturated, substituted or unsubstituted alkyl group. Examples of such an alkyl group include methyl, ethyl, propyl, butyl, cyclopropyl, allyl, t-octyl, 1-butyl, 1-dodecyl, and 2-hexyldecyl.

The heterocyclic group represented by $X^1$ or $X^2$ is a $C_{1-20}$, preferably $C_{1-10}$ 3- to 12-membered, preferably 5- or 6-membered saturated or unsaturated, substituted or unsubstituted, monocyclic or condensed ring heterocyclic group containing at least one nitrogen, oxygen or sulfur atom as a hetero atom. Examples of such a heterocyclic group include 3-pyrrolidinyl, 1,2,4 -triazol-3-yl, 2-pyridyl, 4-pyrimidinyl, 3-pyrazolyl, 2-pyrrolyl, 2,4-dioxo-1,3-imidazolidin-5-yl, and pyranyl.

The aryl group represented by $X^1$ or $X^2$ is a $C_{6-20}$, preferably $C_{6-10}$ substituted or unsubstituted aryl group. Examples of such an aryl group include phenyl and naphthyl.

When $X^3$ represents a nitrogen-containing heterocyclic group which is formed together with

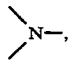

the heterocyclic group is a $C_{1-20}$, preferably $C_{1-15}$ 3- to 12-membered, preferably 5- or 6-membered substituted or unsubstituted, saturated or unsaturated monocyclic or condensed heterocyclic group which may contain as hetero atoms an oxygen atom or a sulfur atom in addition to the nitrogen atom. Examples of such a heterocyclic group include pyrrolidino, piperidino, morpholino, 1-piperadinyl, 1-indolinyl, 1,2,3,4-tetrahydroquinolin-1-yl, 1-imidazolidinyl, 1-pyrazolyl, 1-pyrolinyl, 1-pyrazolidinyl, 2,3-dihydro-1-indazolyl, 2-isoindolinyl, 1-indolyl, 1-pyrolyl, 4-thiazine-S,S-dioxo-4-yl, and benzoxazin-4-yl.

When $X^1$ and $X^2$ each represents a substituted alkyl, aryl or heterocyclic group and $X^3$ forms a substituted nitrogen-containing heterocyclic group together with >N—, examples of the substituents thereof include a halogen atom (e.g., fluorine, chlorine), an alkoxycarbonyl group ($C_{2-30}$, preferably $C_{2-20}$ alkoxycarbonyl group, e.g., methoxycarbonyl, dodecyloxycarbonyl, hexadecyloxycarbonyl), an acylamino group ($C_{2-30}$, preferably $C_{2-20}$ acylamino group, e.g., acetamido, tetradecanamido, 2-(2,4-di-t-amylphenoxy)butanamido, benzamido), a sulfonamido group ($C_{1-30}$, preferably $C_{1-20}$ sulfonamido group, e.g., methanesulfonamido, dodecanesulfonamido, hexadecylsulfonamido, benzenesulfonamido), a carbamoyl group ($C_{1-30}$, preferably $C_{1-20}$ carbamoyl group, e.g., N-butylcarbamoyl, N,N-diethylcarbamoyl), an N-sulfonylcarbamoyl group ($C_{1-30}$, preferably $C_{1-20}$ N-sulfonylcarbamoyl group, e.g., N-mesylcarbamoyl, N-dodecylsulfonylcarbamoyl), a sulfamoyl group ($C_{1-30}$, preferably $C_{1-20}$ sulfamoyl group, e.g., N-butylsulfamoyl, N-dodecylsulfamoyl, N-hexadecylsulfamoyl, N-3-(2,4-di-t-amylphenoxy)butylsulfamoyl, N,N-diethylsulfamoyl), an alkoxy group ($C_{1-30}$, preferably $C_{1-20}$ alkoxy group, e.g., methoxy, hexadecyloxy, isopropoxy), an aryloxy group ($C_{6-20}$, preferably $C_{6-10}$ aryloxy group, e.g., phenoxy, 4-methoxyphenoxy, 3-t-butyl-4-hydroxyphenoxy, naphthoxy), an aryloxycarbonyl group ($C_{7-21}$, preferably $C_{7-11}$ aryloxycarbonyl group, e.g., phenoxycarbonyl), an N-acylsulfamoyl group ($C_{2-30}$, preferably $C_{2-20}$ N-propanoylsulfamoyl, N-tetradecanoylsulfamoyl), a sulfonyl group ($C_{1-30}$, preferably $C_{1-20}$ sulfonyl group, e.g., methanesulfonyl, octanesulfonyl, 4-hydroxyphenylsulfonyl, dodecanesulfonyl), an alkoxycarbonylamino group ($C_{1-30}$, preferably $C_{1-20}$ alkoxycarbonylamino group, e.g., ethoxycarbonylamino), a cyano group, a nitro group, a carboxyl group, a hydroxyl group, a sulfo group, an alkylthio group ($C_{1-30}$, preferably $C_{1-20}$ alkylthio group, e.g., methylthio, dodecylthio, dodecylcarbamoylmethylthio), a ureido group ($C_{1-30}$, preferably $C_{1-20}$ ureido group, e.g., N-phenylureido, N-hexadecylureido), an aryl group ($C_{6-20}$, preferably $C_{6-10}$ aryl group, e.g., phenyl, naphthyl, 4-methoxyphenyl), a heterocyclic group ($C_{1-20}$, preferably $C_{1-10}$ heterocyclic group, e.g., 3- to 12-membered, preferably 5- or 6-membered, monocyclic or condensed ring heterocyclic group containing at least one nitrogen, oxygen or sulfur atom as a hereto atom, such as 2-pyridyl, 3-pyrazolyl, 1-pyrrolyl, 2,4-dioxo-1,3-imidazolidine-1-yl, 2-benzoxazolyl, morpholino, indolyl), an alkyl group ($C_{1-30}$, preferably $C_{1-20}$ straight-chain, branched or cyclic, saturated or unsaturated alkyl group, e.g., methyl, ethyl, isopropyl, cyclopropyl, t-pentyl, t-octyl, cyclopentyl, t-butyl, s-butyl, dodecyl, 2-hexyldecyl), an acyl group ($C_{1-30}$, preferably $C_{2-20}$ acyl group, e.g., acetyl, benzoyl), an acyloxy group ($C_{2-30}$, preferably $C_{2-20}$ acyloxy group, e.g., propanoyloxy, tetradecanoyloxy), an arylthio group ($C_{6-20}$, preferably $C_{6-10}$ arylthio group, e.g., phenylthio, naphthylthio), a sulfamoylamino group ($C_{0-30}$, preferably $C_{0-20}$ sulfamoylamino group, e.g., N-butylsulfamoylamino, N-dodecylsulfamoylamino, N-phenylsulfamoylamino), and an N-sulfonylsulfamoyl group ($C_{1-30}$, preferably $C_{1-20}$ N-sulfonylsulfamoyl group, e.g., N-mesylsulfamoyl, N-ethanesulfamoyl, N-dodecanesulfonylsulfamoyl, N-hexadecanesulfonylsulfamoyl). These substituents may further contain substituents. Examples of such substituents include those described above.

Preferred among these substituents are an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, and an aryl group.

In the general formulae (I) and (II), the aryl group represented by Y is a $C_{6-20}$, preferably a $C_{6-10}$ substituted or unsubstituted aryl group. Typical examples of such an aryl group include a phenyl group and a naphthyl group.

The heterocyclic group represented by Y in the general formulae (I) and (II) has the same meaning as defined with reference to $X^1$ or $X^2$.

When Y represents a substituted aryl group or substituted heterocyclic group, examples of substituents to be contained therein include those described with reference to $X^1$. In a preferred example, one of substituents contained in the substituted aryl group or substituted heterocyclic group represented by Y is a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

In the general formulae (I) and (II), the group represented by Z may be any known coupling-releasing group. Preferred examples of such a group include a nitrogen-containing heterocyclic group which is connected to the coupling position via a nitrogen atom, an aryloxy group, an arylthio group, a heterocyclic oxy group, a heterocyclic thio group, an acyloxy group, a carbamoyloxy group, an alkylthio group, or a halogen atom.

Such a releasing group may either be a nonphotographically useful group or a photographically useful group or precursor thereof (e.g., development inhibitor, development accelerator, desilvering accelerator, fogging agent, dye, film hardener, coupler, scavenger of oxidation product of developing agent, fluorescent dye, developing agent, electron transfer agent).

The photographically useful groups represented by Z which can preferably be used include those that are commonly known. Examples of such photographically useful groups include those disclosed in U.S. Pat. Nos.

4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, and 4,741,994, and European Patent Disclosure Nos. 193389A, 348139A and 272573A and releasing groups (e.g., timing group) for releasing these photographically useful groups.

When Z represents a nitrogen-containing heterocyclic group which is bonded to the coupling position via the nitrogen atom, it is preferably a $C_{1-15}$, more preferably $C_{1-10}$ 5- or 6-membered substituted or substituted, saturated or unsaturated, monocyclic or condensed heterocyclic group. The heterocyclic group may contain an oxygen atom or a sulfur atom besides the nitrogen atom as a hetero atom. Specific preferred examples of such a heterocyclic group include 1-pyrazolyl, 1-imidazolyl, pyrrolino, 1,2,4-triazol-2-yl, 1,2,3-triazol-3-yl, benzotriazolyl, benzimidazolyl, imidazolidine-2,4-dione-3-yl, oxazolidine-2,4-dione-3-yl, 1,2,4 -triazolidine-3,5-dione-4-yl, 2-imidazolinone-1-yl, 3,5-dioxomorpholino, and 1-indazolyl. When these heterocyclic groups contain substituents, examples of these substituents include those described as substituents which may be contained in the group represented by $X^1$. Preferably, one of these substituents is an alkyl group, an alkoxy group, a halogen atom, an alkoxycarbonyl group, an aryloxycarbonyl group, an alkylthio group, an acylamino group, a sulfonamide group, an aryl group, a nitro group, a carbamoyl group or a sulfonyl group.

When Z represents an aromatic oxy group, it is preferably a $C_{6-10}$ substituted or unsubstituted aromatic oxy group, particularly a substituted or unsubstituted phenoxy group. When the aromatic oxy group represented by Z contains substituents, examples of such substituents include those described as substituents which may be contained in the group represented by $X^1$. Preferably, at least one of these substituents is an electrophilic substituent. Examples of such an electrophilic substituent include a sulfonyl group, an alkoxycarbonyl group, a sulfamoyl group, a halogen atom, a carboxyl group, a nitro group, a cyano group, and an acyl group.

When Z represents an aromatic thio group, it is preferably a $C_{6-10}$ substituted or unsubstituted aromatic thio group, particularly a substituted or unsubstituted phenylthio group. When the aromatic thio group represented by Z contains substituents, examples of such substituents include those described as substituents which may be contained in the group represented by $X^1$. Preferably, at least one of these substituents is an alkyl group, an alkoxy group, a sulfonyl group, an alkoxycarbonyl group, a sulfamoyl group, a halogen atom, a carbamoyl group or a nitro group.

When Z represents a heterocyclic oxy group, the heterocyclic group portion thereof is a $C_{1-20}$, preferably $C_{1-10}$ 3- to 12-membered, preferably 5- or 6-membered substituted or unsubstituted, saturated or unsaturated, monocyclic or condensed heterocyclic group containing at least one nitrogen atom, oxygen atom or sulfur atom as a hetero atom. Examples of such a heterocyclic oxy group include a pyridyloxy group, a pyrazolyloxy group, and a furyloxy group. When the heterocyclic oxy group represented by Z contains substituents, examples of such substituents include those described as substituents which may be contained in the group represented by $X^1$. Preferably, one of these substituents is an alkyl group, an aryl group, a carboxyl group, an alkoxy group, a halogen atom, an alkoxycarbonyl group, an aryloxycarbonyl group, an alkylthio group, an acylamino group, a sulfonamide group, a nitro group, a carbamoyl group or a sulfonyl group.

When Z represents a heterocyclic thio group, the heterocyclic group portion thereof is a $C_{1-20}$, preferably $C_{1-10}$ 3- to 12-membered, preferably 5- or 6-membered substituted or unsubstituted, saturated or unsaturated, monocyclic or condensed heterocyclic group containing at least one nitrogen atom, oxygen atom or sulfur atom as a hetero atom. Examples of such a heterocyclic thio group include a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, and a 2-pyridylthio group. When the heterocyclic thio group represented by Z contains substituents, examples of such substituents include those described as substituents which may be contained in the group represented by $X^1$.

When Z represents a carbamoyloxy group, it is a $C_{1-30}$, preferably $C_{1-20}$ aliphatic, aromatic or heterocyclic substituted or unsubstituted carbamoyloxy group. Examples of such a carbamoyloxy group include N,N-diethylcarbamoyloxy, N-phenylcarbamoyloxy, 1-imidazolylcarbonyloxy, and 1-pyrrolecarbonyloxy. When the carbamoyloxy group represented by Z contains substituents, examples of such substituents include those described as substituents which may be contained in the group represented by $X^1$.

When Z represents an alkylthio group, it is a $C_{1-30}$, preferably $C_{1-20}$ straight-chain, branched or cyclic, saturated or unsaturated, substituted or unsubstituted alkylthio group. When the alkylthio group represented by Z contains substituents, examples of such substituents include those described as substituents which may be contained in the group represented by $X^1$.

Particularly preferred ranges of the couplers represented by the general formula (I) and (II) will be described hereinafter.

In the general formula (I), the group represented by $X^1$ is preferably an alkyl group, particularly a $C_{1-10}$ alkyl group.

In the general formulae (I) and (II), the group represented by Y is preferably an aromatic group, particularly a phenyl group containing at least one substituent in the ortho position. Examples of such a substituent include those described as substituents which may be contained in the aromatic group represented by Y. Similarly, preferred examples of such a substituent include those described as preferred substituents which may be contained in the aromatic group represented by Y.

In the general formulae (I) and (II), the group represented by Z is preferably a 5- or 6-membered nitrogen-containing heterocyclic group which is bonded to the coupling position via the nitrogen atom, a 5- or 6-membered aromatic oxy group, a 5- or 6-membered heterocyclic oxy group or a 5- or 6-membered heterocyclic thio group.

Preferred examples of the couplers represented by the general formulae (I) and (II) are represented by the following general formulae (III), (IV) and (V):

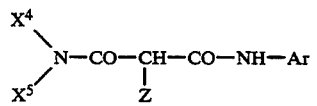

(III)

-continued (IV)

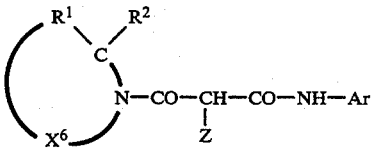

(V)

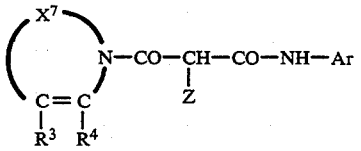

wherein Z is as defined in the general formula (i); $X^4$ represents an alkyl group; $X^5$ represents an alkyl group or an aromatic group; Ar represents a phenyl group containing at least one substituent in the ortho position thereof; $X^6$ represents an organic residue which forms a nitrogen-containing heterocyclic group (monocyclic or condensed) together with $—C(R^1R^2)—N<$; $X^7$ represents an organic residue which forms a nitrogen-containing heterocyclic group (monocyclic or condensed ring) together with $—C(R^3)=C(R^4)—N<$; and $R^1$, $R^2$, $R^3$ and $R^4$ each represents a hydrogen atom or a substituent.

In the general formulae (III) to (V), the detailed description and preferred ranges of the groups represented by $X^4$ to $X^7$, Ar and Z are the same as those given with reference to the general formulae (I) and (II).

When $R^1$ to $R^4$ represent substituents, examples of such substituents include those described as substituents which may be contained in the group represented by $X^1$.

Particularly preferred among the couplers represented by the general formulae (III), (IV) and (V) are those represented by the general formulae (IV) and (V).

The couplers represented by the general formulae (I) to (V) may form a dimer or higher polymer (e.g., telomer or polymer) connected via a group having a valency or 2 or more to the group represented by $X^1$ to $X^7$, Y, Ar, $R^1$ to $R^4$, or Z. In this case, the number of carbon atoms contained in the substituents may deviate from the range as defined above.

The couplers represented by the general formulae (I) to (V) are preferably nondiffusible couplers. The term "nondiffusible coupler" as used herein means a "coupler which contains in its molecule a group that gives a molecular weight high enough to immobilize the molecule in a layer in which it has been incorporated". In general, a $C_{8-30}$, preferably $C_{10-20}$ alkyl group or $C_{4-20}$ substituted aryl group is used. Such a nondiffusible group may be substituted at any portion in the molecule. There may be contained a plurality of such nondiffusible groups in the molecule.

Specific examples of the couplers represented by the general formulae (I) to (V) will be set forth below, but the present invention should not be construed as being limited thereto.

(1)

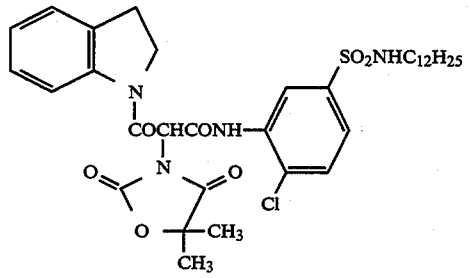

(2)

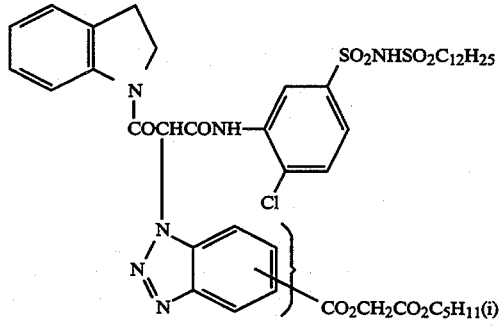

-continued
(3)
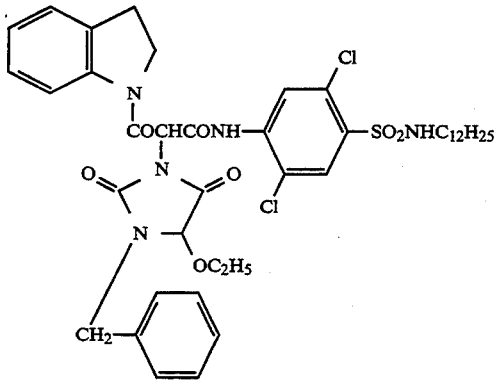
(4)
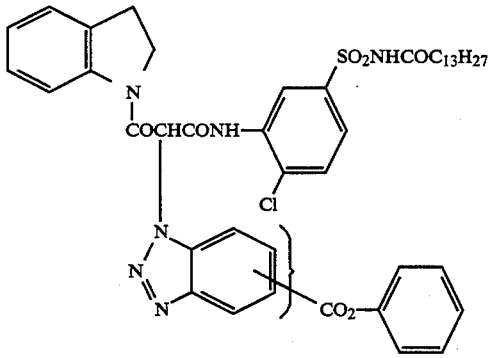
(5)
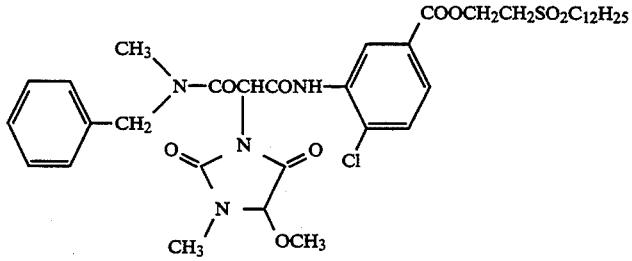
(6)
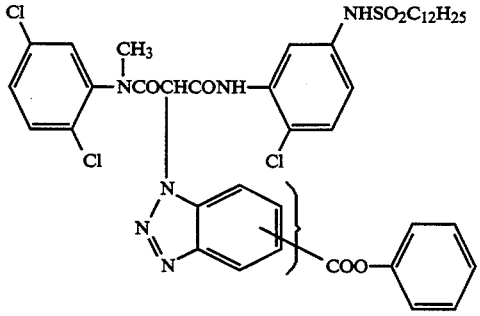
(7)
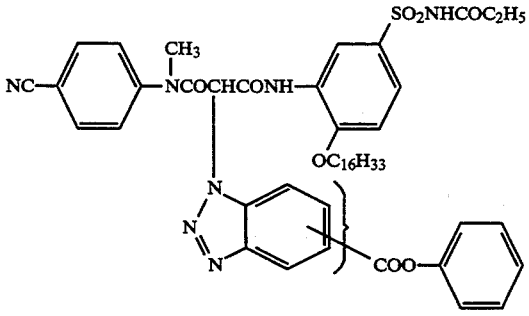

-continued
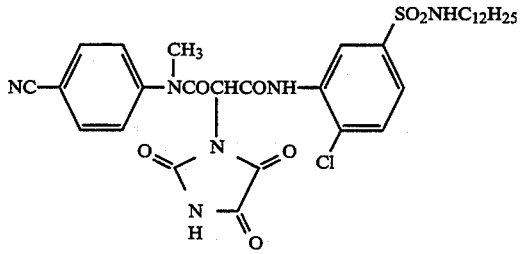
(8)
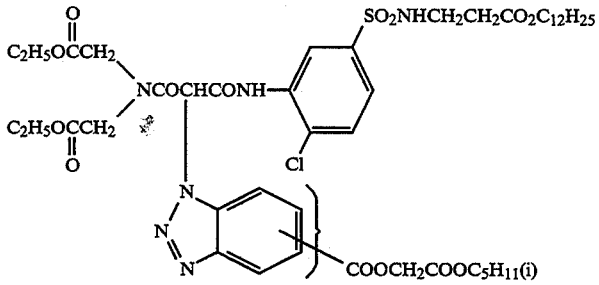
(9)
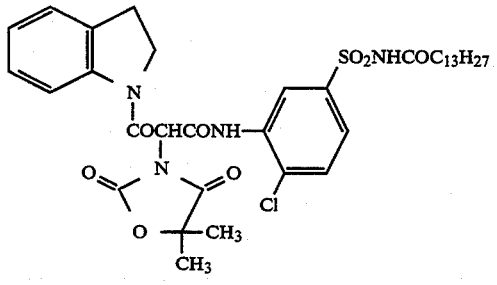
(10)
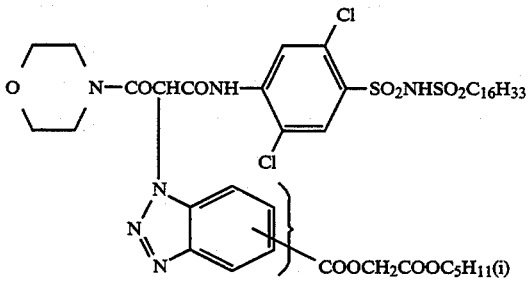
(11)
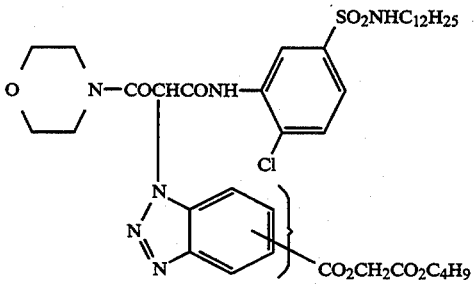
(12)

-continued
(13)
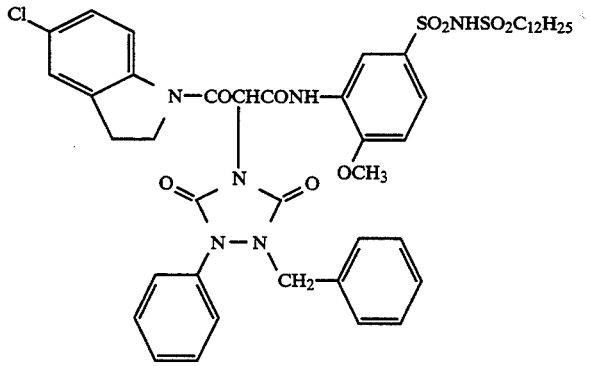
(14)
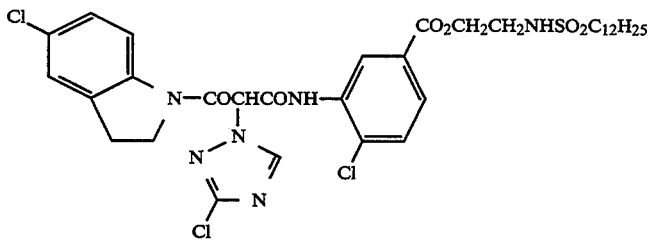
(15)
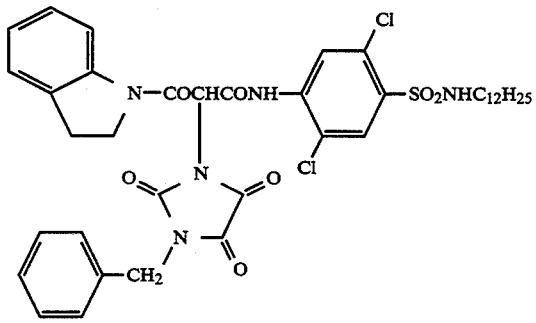
(16)
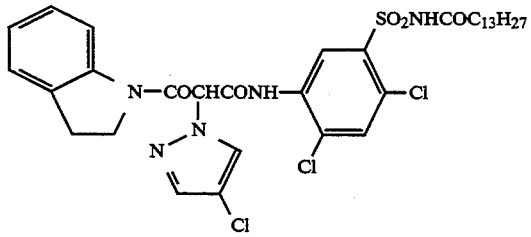
(17)
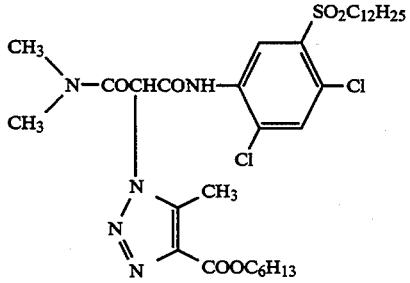

-continued
(18)
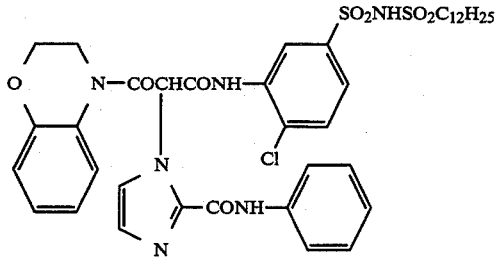
(19)
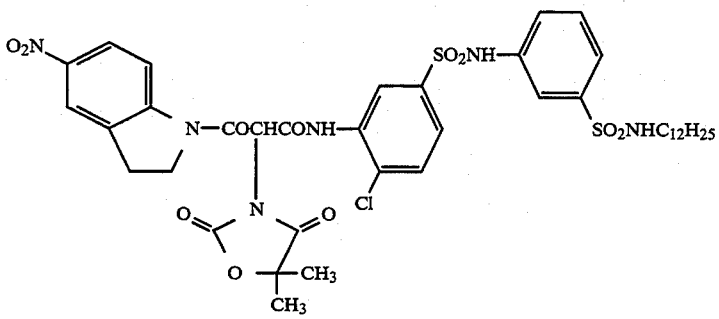
(20)
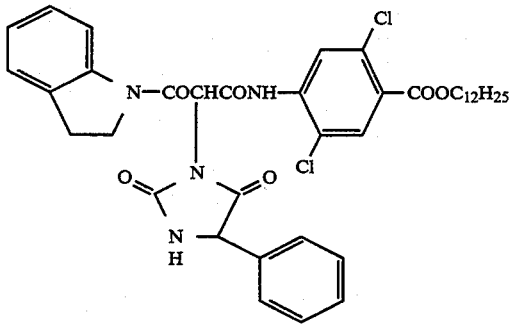
(21)
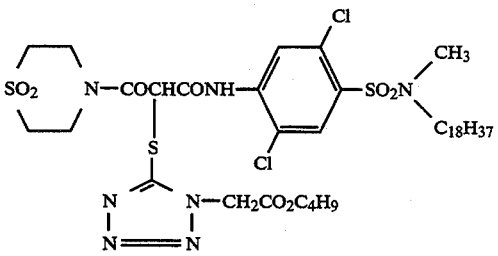
(22)
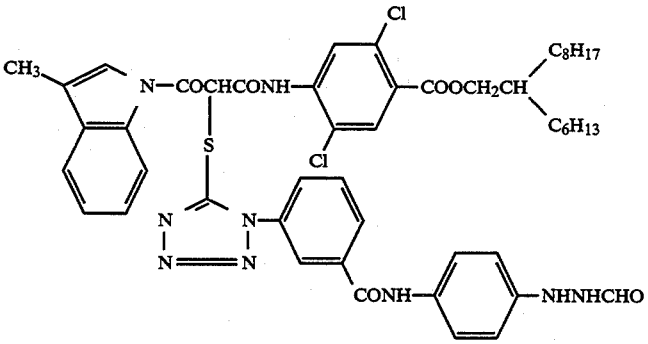

-continued
(23)
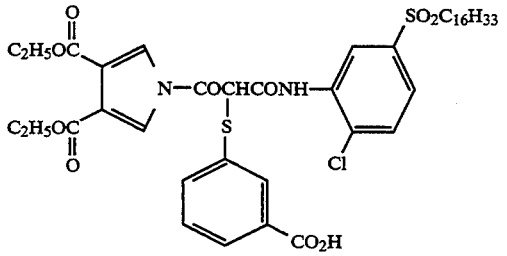
(24)
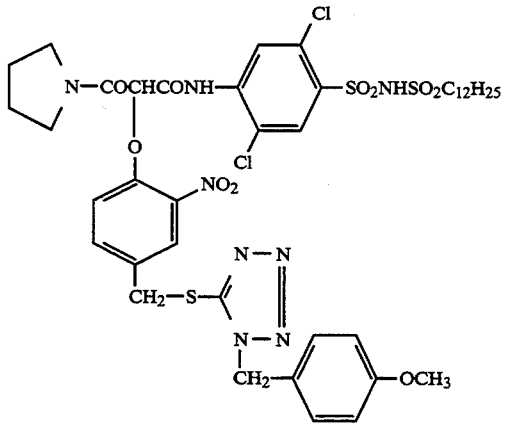
(25)
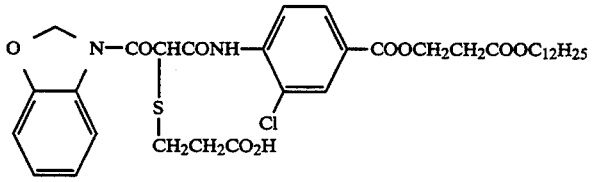
(26)
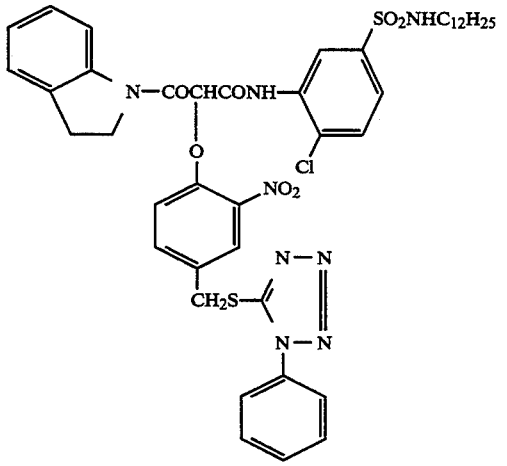
(27)
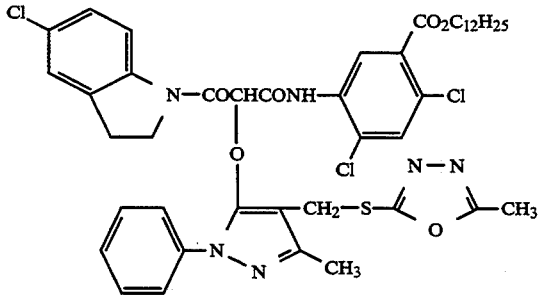

-continued
(28)
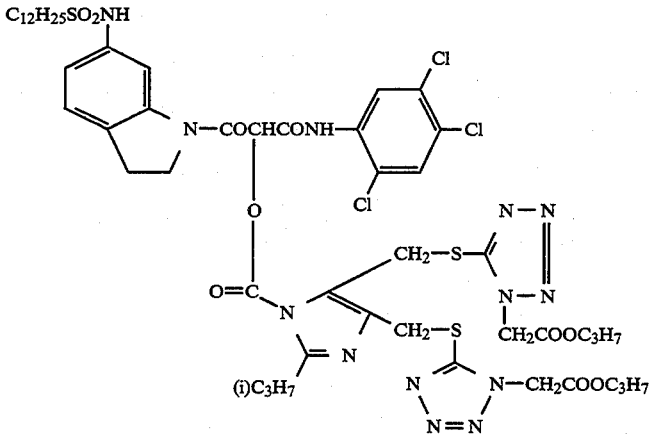
(29)
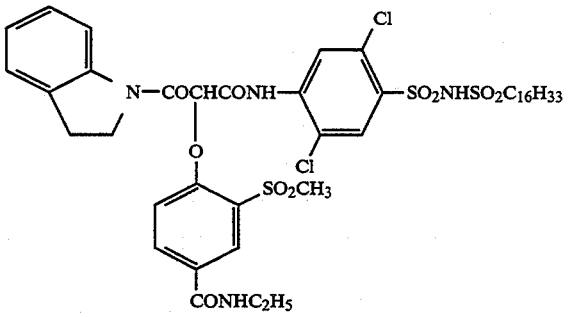
(30)
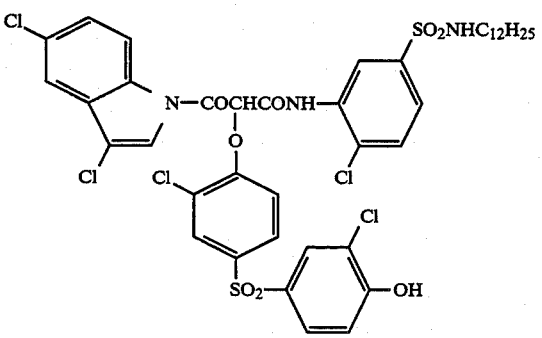
(31)
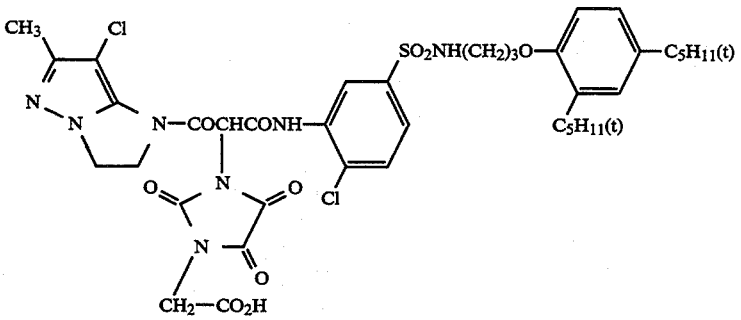

-continued
(32)
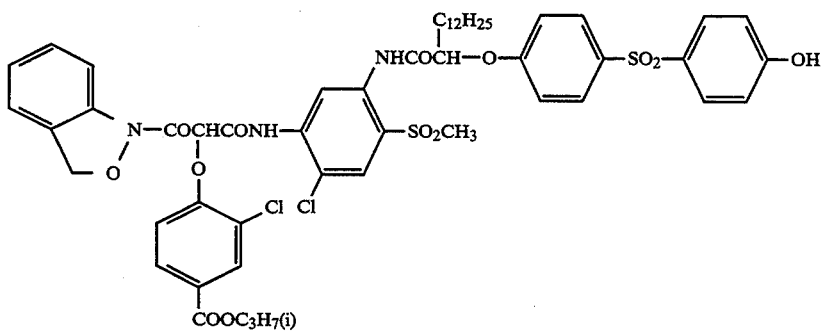
(33)
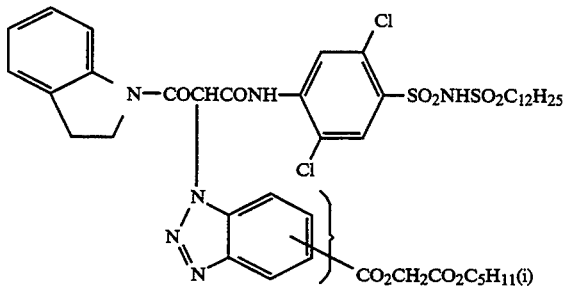
(34)
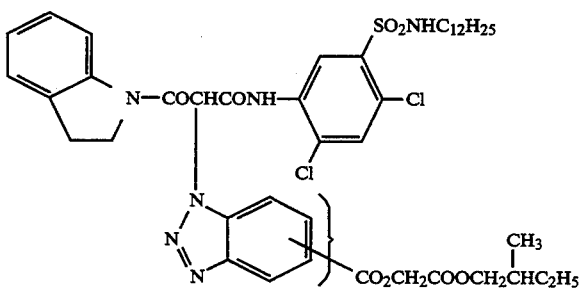
(35)
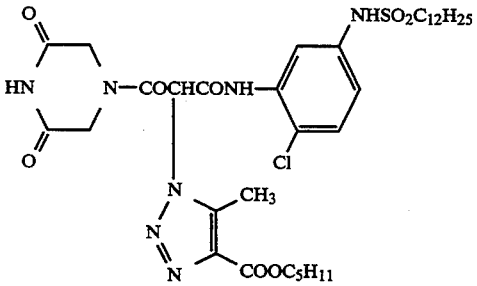
(36)
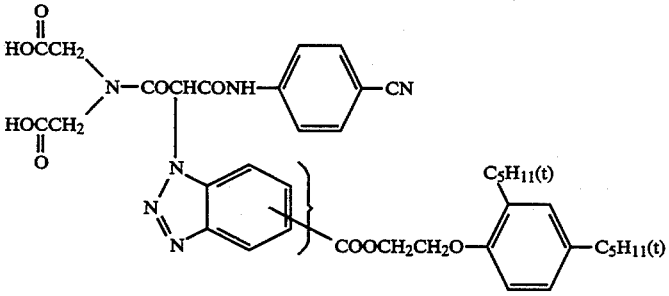

-continued
(37)
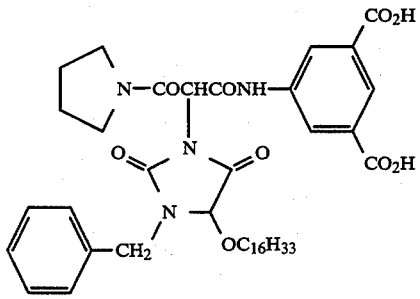
(38)
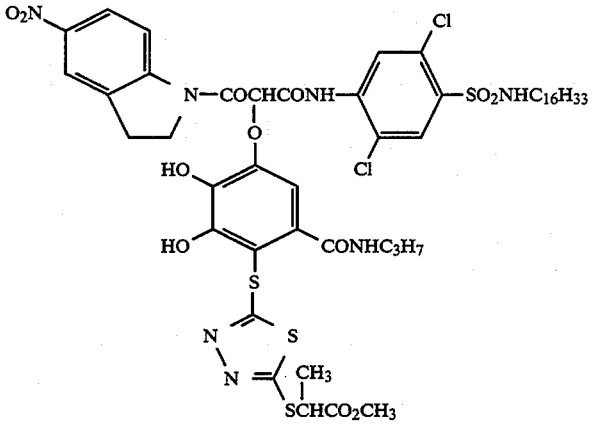
(39)
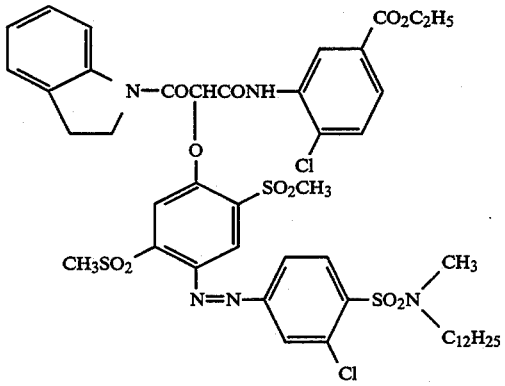
(40)
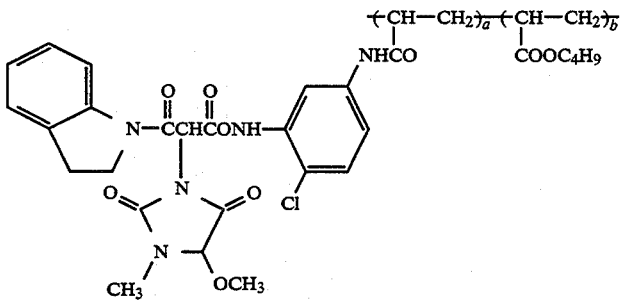
a/b = 1/1 (weight ratio)
Average molecular weight: 30,000

-continued (41)

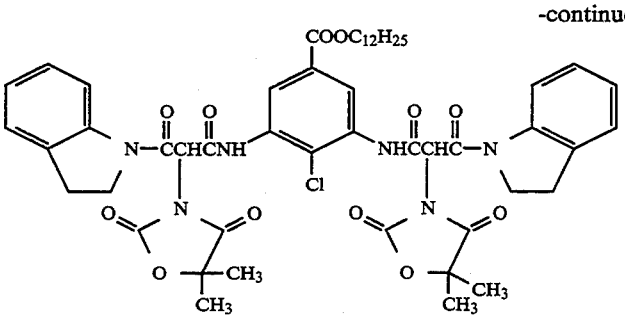

(42)

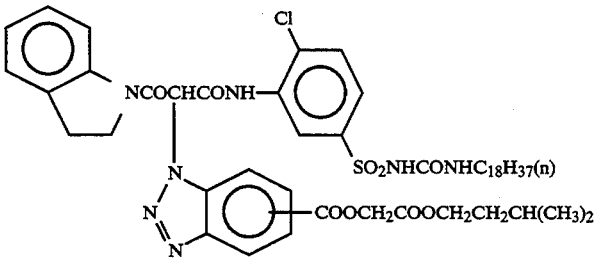

(43)

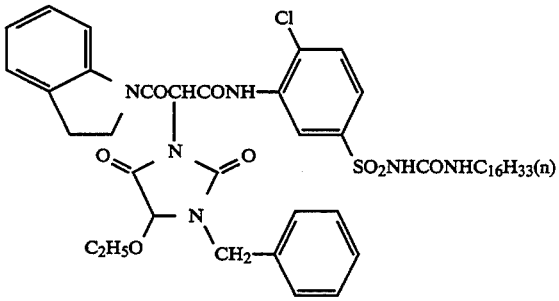

(44)

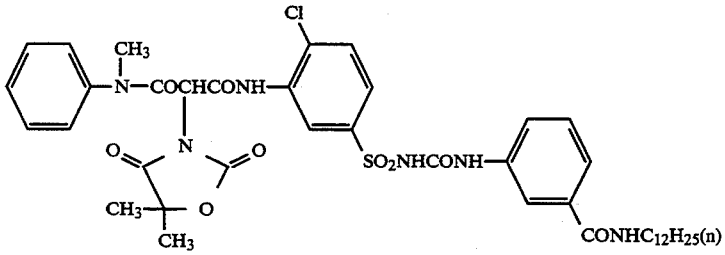

(45)

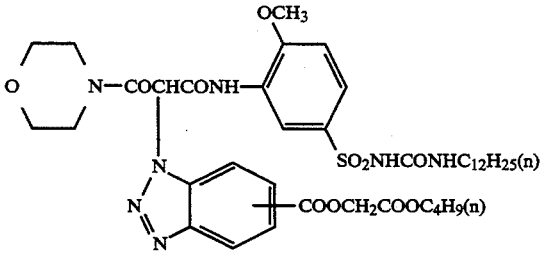

The coupler of the present invention is preferably incorporated in a light-sensitive silver halide emulsion layer or its adjacent layers, particularly in a light-sensitive silver halide emulsion layer of the light-sensitive material. The total amount of the coupler to be incorporated in the light-sensitive material is, if the separatable group Z contains a photographically useful group component, in the range of 0.0001 to 0.80 g/m$^2$, preferably 0.0005 to 0.50 g/m$^2$, more preferably 0.02 to 0.30 g/m$^2$, or, if not, in the range of 0.001 to 1.20 g/m$^2$, preferably 0.01 to 1.00 g/m$^2$, more preferably 0.10 to 0.80 g/m$^2$.

The coupler of the present invention can be incorporated in the light-sensitive material in the same manner as ordinary couplers.

SYNTHESIS EXAMPLE 1: Synthesis of Illustrated Coupler (1)

Coupler (1) was prepared according to the following synthesis process:

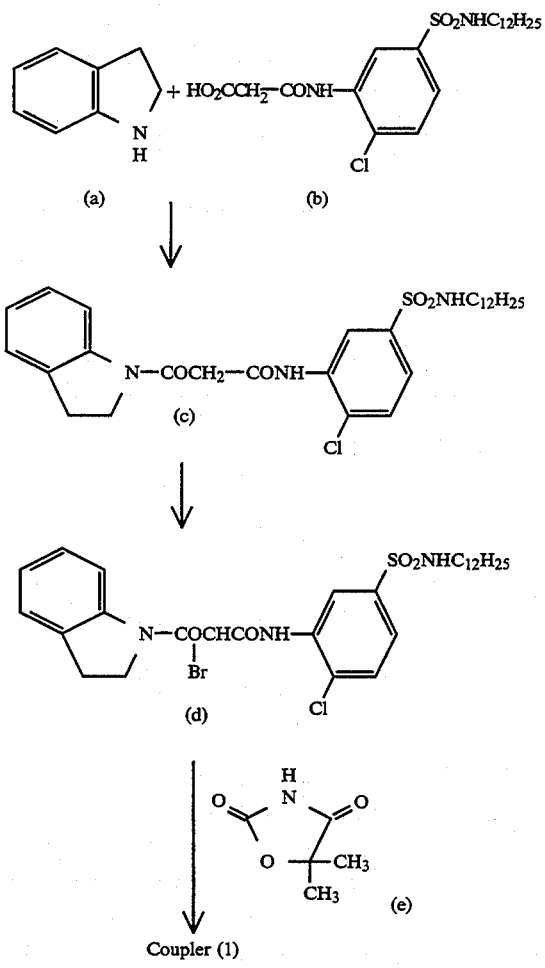

Step 1: 3.5 g of Compound (a) and 13 g of Compound (b) were dissolved in a mixture of 100 ml of N,N-dimethylformamide and 100 ml of acetonitrile. To the solution was added dropwise 40 ml of an acetonitrile solution of 6 g of N,N'-dicyclohexylcarbodiimide at room temperature. After 2 hours of reaction, the resulting N,N'-dicyclohexylurea was filtered off. The filtrate was poured into 500 ml of water, and then extracted with 500 ml of ethyl acetate. The material was then transferred to a separatory funnel where it was then washed with water. The resulting oil phase was then separated from the aqueous phase. The solvent was then distilled off under reduced pressure. To the residue was then added hexane to effect crystallization. As a result, 16.1 g of Compound (c) was obtained.

Step 2: 16 g of Compound (c) was mixed with 150 ml of dichloromethane. To the mixture was then added dropwise a solution of 4.8 g of bromine in 10 ml of dichloromethane under cooling with ice (5° C. to 10° C.). After 10 minutes of reaction, the reaction system was then transferred to a separatory funnel where it was then washed with water. The oil phase (containing Compound (d)) was recovered for subsequent use.

Step 3: 8.2 g of Compound (c) and 8.8 ml of triethylamine were added to 160 ml of N,N-dimethylformamide. To the solution was added dropwise the previously obtained dichloromethane solution at room temperature. After 1 hour of reaction, 500 ml of ethyl acetate was added to the reaction system. The reaction system was transferred to a separatory funnel where it was then washed with water. The material was neutralized with dilute hydrochloric acid, and then again washed with water. The oil phase was separated from the aqueous phase. The solvent was then distilled off under reduced pressure. The residue was then separated and purified through column chromatography using silica gel as a filler and a 1:1 mixture of ethyl acetate and hexane as an elute. A fraction containing the desired compound was then recovered. The solvent was distilled off under reduced pressure to obtain 16.3 g of Coupler (1) in the form of a wax.

SYNTHESIS EXAMPLE 2: Synthesis of Illustrated Coupler (2)

Coupler (2) was prepared in the same manner as in Synthesis Example 1 except that Compounds (f) and (g) were used instead of Compounds (b) and (e), respectively, in equimolecular amounts. As a result, 15.4 g of Coupler (2) was obtained as the desired compound in the form of a wax.

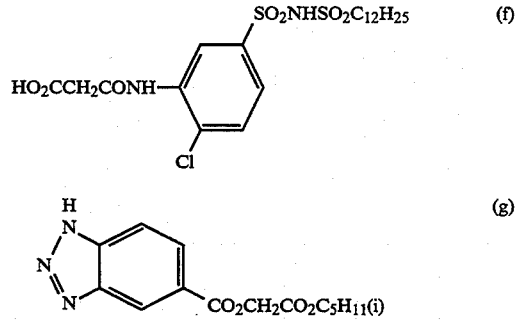

SYNTHESIS EXAMPLE 3: Synthesis of Illustrated Coupler (6)

Coupler (6) was prepared according to the reaction process given by the following scheme:

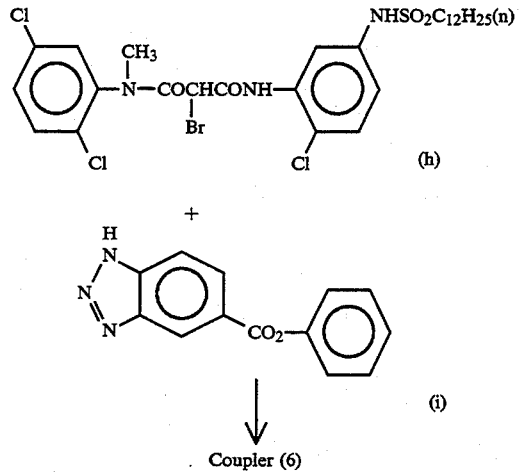

4.42 g of Compound (i) and 1.87 g of triethylamine were added to 50 ml of N,N-dimethylformamide. The mixture was stirred for 10 minutes. To the solution was then added dropwise a solution of 6.23 g of Compound (h) in 20 ml of methylene chloride at room temperature in 15 minutes. After 1 hour of reaction, the reaction solution was poured into water and then extracted with ethyl acetate. The organic phase was dried with magnesium sulfate as a drying agent which was then filtered off. The solvent was distilled off under reduced pressure. The residue was then purified through silica gel column chromatography to obtain 4.7 g of Coupler (6) as the desired compound in the form of a white powder.

The silver halide grains of the present invention will be further described hereinafter.

The emulsion layer of the present invention needs to comprise silver iodobromide containing 15 to 45 mol % of silver iodide present in a definite layer structure. The emulsion layer of the present invention also needs to comprise chemically sensitized silver halide grains having a total silver iodobromide content of more than 7 mol %. If silver iodide is present in an amount of more than 45 mol %, it cannot be dissolved in the solid. If present in an amount of less than 15 mol %, it causes a remarkable deterioration in graininess.

The definite layer structure as defined herein can be judged by an X-ray diffraction process. Examples of application of the X-ray diffraction process to the evaluation of silver halide grains are described in H. Hirsch, "Journal of Photographic Science", vol. 10, 1962, pp. 129–146. If the lattice constant is determined by the halogen composition, a diffraction peak occurs at a diffraction angle which satisfies Bragg condition ($2d \sin \theta = n\lambda$).

The X-ray diffraction measurement process is described in detail in "Kiso Bunseki Kagaku Koza 24 "Ekkusu-sen Kaiseki" (Basic Analytical Chemistry Institute 24 (X-ray Diffraction)", Kyoritsu Shuppan, "Ekkusu-sen Kaiseki no Tebiki (Introduction to X-ray Diffraction)", Rigaku Denki K.K., etc. In a standard measurement process, Cu is used as a target. K$\beta$ ray from Cu is used as a radiation source (tube voltage: 49 kV; tube current: 50 mA) to determine the diffraction curve of the 220 plane of silver halide. In order to enhance the resolution of the measuring instrument, it is necessary that the width of the slit (emission slit, reception slit, etc.), the time constant of the equipment, the scanning rate of the goniometer, and the recording rate be properly selected and the measurement precision be confirmed by means of a standard specimen such as silicon.

The definite layer structure as defined herein is such that the diffraction intensity vs. diffraction angle curve of the 220 plane of silver halide obtained with K$\beta$ ray from Cu in the diffraction angle range of 38° to 42° have at least two diffraction peaks corresponding to a high iodine layer containing 15 to 45 mol % of silver iodide and a low iodine layer containing 8 mol % or less of silver iodide, respectively, and a minimum diffraction therebetween, the ratio of the diffraction intensity corresponding to the high iodine layer to that of the low iodine layer being in the range of 1/10 to 3/1, preferably ⅓ to 3/1.

In the emulsion of the present invention having substantially two definite layer structures, the intensity of the minimum diffraction between two or more (preferably two) peaks is preferably 90% or less, more preferably 80% or less, particularly 60% or less than that of the weakest one of the two or more maximum diffractions (peaks). Methods for analyzing a diffraction curve consisting of two diffraction components are well known in the art and described in, e.g., "Jikken Butsurigaku Koza (Experimental Physics Institute) 11—Koshi Kekkan (Lattice Defect)", Kyoritu Shuppan.

In another useful method, a diffraction curve is assumed as a function, such as a Gaussian function and a Lorentz function and analyzed by means of a curve analyzer manufactured by Du Pont or the like.

Even an emulsion comprising two kinds of grains having different halogen compositions which exhibit no mutually definite layer structures shows two peaks when analyzed by the above mentioned X-ray diffraction process.

Such an emulsion cannot exhibit excellent photographic properties as obtained in the present invention.

The judgement of whether the silver halide emulsion in question is according to the present invention or one comprising two kinds of silver halide grains as mentioned above can be accomplished by the X-ray diffraction process as well as EPMA (Electron-Probe Micro Analyzer) process.

In this process, a test specimen comprising emulsion grains well dispersed so that they do not come into contact with each other is irradiated with an electron beam. The X-ray analysis by electron ray excitation enables an elemental analysis of minute portions.

In accordance with this process, the characteristic X-ray intensity of silver and iodine emitted by each lattice can be evaluated to determine the halogen composition of each grain.

By confirming the halogen composition of at least 50 grains by an EPMA process, it can be judged whether or not the emulsion in question is according to the present invention.

In the emulsion of the present invention, the iodine content is preferably as uniform as possible between grains.

When the distribution of the iodine content between grains is determined by the EPMA process, the relative standard deviation is preferably in the range of 50% or less, more preferably 35% or less.

Another preferred intergrain iodine content distribution is such that the logarithm of grain size and the iodine content show a positive correlation therebetween, that is, large size grains have a high iodine content while small size grains have a low iodine content. An emulsion exhibiting such a relationship gives excellent results with respect to graininess. The coefficient of correlation is preferably in the range of 40% or more, more preferably 50% or more.

In the core of the silver halide grains, silver halide other than silver iodide may be either silver chlorobromide or silver bromide. The proportion of silver bromide is preferably high. The silver iodide content may be in the range of 15 to 45 mol %, preferably 25 to 45 mol %, more preferably 30 to 45 mol %. The most preferred silver halide in the core of the silver halide grains is silver iodobromide containing 30 to 45% of silver iodide.

The composition of the outermost layer of the silver halide grains is preferably silver halide containing 8 mol % or less, more preferably 6 mol % or less of silver iodide.

Silver halide other than silver iodide in the outermost layer of the silver halide grains may be any of silver chloride, silver chlorobromide and silver bromide. The proportion of silver bromide is preferably high. The most preferred silver halide in the outermost layer of the silver halide grains is silver iodobromide containing 0.5 to 6 mol % of silver iodide or silver bromide.

The halogen composition in the entire grain needs to be adjusted such that the silver iodide content is in the range of more than 7 mol %, preferably 10 to 25 mol %, more preferably 12 to 20 mol %.

One of the reasons why the silver halide emulsion to be used in the present invention exhibits an excellent graininess is that since a high iodine content can be attained without deteriorating development activity, light absorption increases. A greater possible reason is that the definite layer structure comprising a high iodine layer in a part of the core of the grain and a low iodine layer in the outermost layer of the grain provides some improvement in the efficiency of forming latent images.

The size of silver halide grains having a definite layer structure as defined herein is in the range of 0.05 to 3.0 μm, preferably 0.1 to 1.5 μm, more preferably 0.2 to 1.3 μm, further preferably 0.3 to 1.0 μm.

The average grain size of silver halide grains as defined herein is the arithmetic mean of grain sizes well known in the art as described in T. H. James et al., "The Theory of the Photographic Process", vol. 3, page 39, Macmillan, 1966. The grain diameter as defined herein is represented in terms of diameter of sphere as described in Masafumi Arakawa, "Ryudo Sokutei Nyumon (Introduction to Measurement of Grain Size)", Funtai Kogaku Kaishi, vol. 17, pp. 299–313, 1980 and can be measured by any suitable method such as coal tar counter method, single grain light scattering method and laser light scattering method.

The silver halide grains having a definite layer structure as defined herein may have a regular crystal form such as hexahedron, octahedron, dodecahedron and tetradecahedron or an irregular crystal form such as sphere, potato-like form and tablet. In particular, tabular twinning grains with an aspect ratio of 1.2 to 8, preferably 1.5 to 5 are preferred.

Among regular crystal grains, those having a 111 plane in a proportion of 50% or more are particularly preferred. Similarly, among irregular crystal grains, those having a 111 plane in a proportion of 50% or more are particularly preferred. The proportion of 111 plane can be determined by the Kubelka Munk dye adsorption method. In this method, a dye which is preferentially adsorbed to either a 111 plane or a 100 plane and differs spectrally in its association between the 111 plane and the 100 plane is selected. The spectrum versus the amount of such a dye added to the emulsion can be specifically examined to determine the proportion of the 111 plane.

The emulsion of the present invention may be incorporated in any layers in the silver halide photographic material, preferably in a blue-sensitive emulsion layer containing a yellow coupler of the present invention. In the present invention, the light-sensitive emulsion layer preferably consists of two or more layers having different sensitivities. In particular, the emulsion of the present invention is preferably incorporated in layers other than the layer having the lowest sensitivity.

In the present invention, compounds represented by the following general formula (A) are particularly preferred:

$$Q-SM^1 \qquad (A)$$

wherein Q represents a heterocyclic residue comprising at least one of $-SO_3M^2$, $-COOM^2$, —OH and $-NR^1R^2$ directly or indirectly connected thereto; $M^1$ and $M^2$ each independently represents a hydrogen atom, an alkaline metal, a quaternary ammonium or a quaternary phosphonium; and $R^1$ and $R^2$ each represents a hydrogen atom or a substituted or unsubstituted alkyl group.

Specific examples of the heterocyclic residue represented by Q in the general formula (A) include an oxazole ring, thiazole ring, imidazole ring, selenazole ring, triazole ring, tetrazole ring, thiadiazole ring, oxadiazole ring, pentazole ring, pyrimidine ring, thiadia ring, triazine ring, thiadizine ring, and rings comprising other carbon rings connected to heterocyclic rings, such as benzothiazole ring, benzotriazole ring, benzimidazole ring, benzoxazole ring, benzoselenazole ring, naphthoxazole ring, triazaindolizine ring, diazaindolizine ring, and tetrazaindolizine ring.

Particularly preferred among mercaptoheterocyclic compounds represented by the general formula (A) are those represented by the following general formulae (B) and (C):

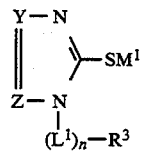

(B)

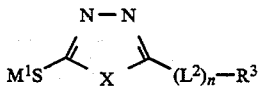

(C)

In the general formula (B), Y and Z each independently represents a nitrogen atom or $CR^4$ in which $R^4$ represents a hydrogen atom, a substituted or unsubstituted alkyl group or a substituted or unsubstituted aryl group; $R^3$ represents an organic residue substituted by at least one selected from the group consisting of $-SO_3M^2$, $-COOM^2$, —OH and $-NR^1R^2$ wherein $M^2$, $R^1$ and $R^2$ are as defined above, such as a $C_{1-20}$ alkyl group (e.g., methyl, ethyl, propyl, hexyl, dodecyl, octadecyl) and a $C_{6-20}$ aryl group (e.g., phenyl, naphthyl) substituted with the above substituent, for example, $-CH_2-COOH$, $-CH_2CH_2-COOH$, $-CH_2CH_2SO_3Na$, $-CH_2CH(SO_3Na)CH_3$, $-CH_2CH_2NH_2$, $-(CH_2)_4-SO_3Na$,

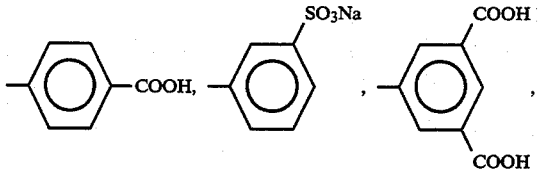

etc.; $L^1$ represents a linking group selected from the group consisting of —S—, —O—, —N—, —CO—, —SO— and $-SO_2-$; and n represents an integer 0 or 1.

These alkyl groups and aryl groups may be further substituted by other substituents such as a halogen atom (e.g., F, Cl, Br), an alkoxy group (e.g., methoxy, methoxyethoxy), an aryloxy group (e.g., phenoxy), an alkyl group (when $R^2$ is an aryl group), an amido group (e.g., acetamide, benzoylamino), a carbamoyl group (e.g., unsubstituted carbamoyl, phenylcarbamoyl, methylcarbamoyl), a sulfonamido group (e.g., unsubstituted sulfamoyl, methylsulfamoyl, phenylsulfamoyl), a sulfonyl group (e.g., methylsulfonyl, phenylsulfonyl), a sulfinyl group (e.g., methylsulfinyl, phenylsulfinyl), a cyano group, an alkoxycarbonyl group (e.g., methoxycarbonyl), an aryloxycarbonyl group (e.g., phenoxycarbonyl), and a nitro group.

When $R^3$ contains two or more substituents $—SO_3M$, $—COOM^2$, —OH and $—NR_1R^2$, the substituents may be the same or different.

$M^2$ is as defined in general formula (A).

In the general formula (C), X represents a sulfur atom, an oxygen atom or $—N(R^5)—$ in which $R^5$ represents a hydrogen atom, a substituted or unsubstituted alkyl group or a substituted or unsubstituted aryl group.

$L^2$ represents $—CONR^6—$, $—NR^6CO—$, $—SO_2NR^6—$, $—NR^6SO_2—$, —OCO—, —COO—, —S—, $—NR^6—$, —CO—, —SO—, —OCOO—, $—NR^6CONR^7—$, $—NR^6COO—$, $—OCONR^6—$ or $—NR^6SO_2NR^7—$ in which $R^6$ and $R^7$ each represents a hydrogen atom, a substituted or unsubstituted alkyl group or a substituted or unsubstituted aryl group.

$R^3$ and $M^2$ are as defined in the general formulae (A) and (B), and n represents an integer 0 or 1.

Examples of substituents which may be contained in the alkyl group and aryl group represented by $R^4$, $R^5$, $R^6$ and $R^7$ include those described as substituents which may be contained in $R^3$.

In these general formulae, $R^3$ is particularly preferably $—SO_3M^2$ or $—COOM^2$.

Specific preferred examples of the compound represented by the general formula (A) which can be used in the present invention are set forth below:

(1)

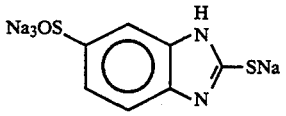

(2)

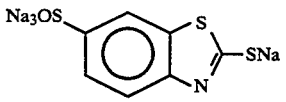

(3)

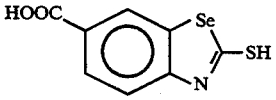

(4)

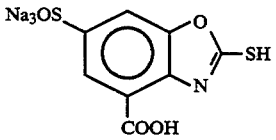

(5)

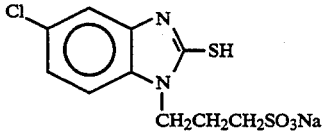

(6)

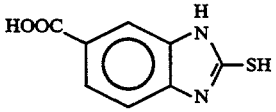

(7)

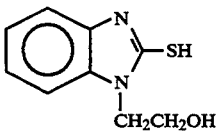

-continued (8)

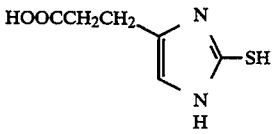

(9)

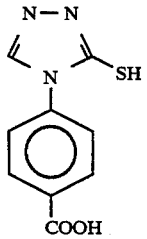

(10)

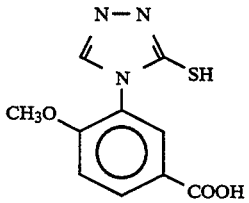

(11)

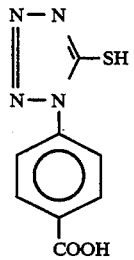

(12)

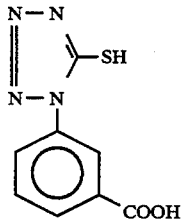

(13)

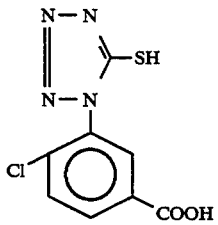

(14)

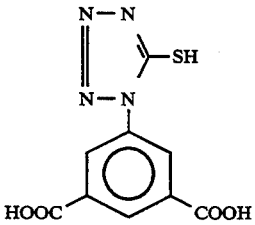

-continued
(15)
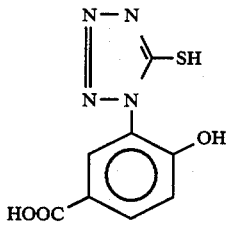
(16)
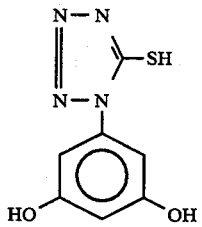
(17)
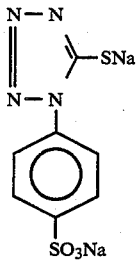
(18)
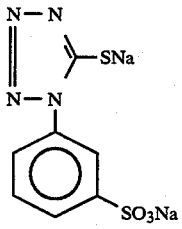
(19)
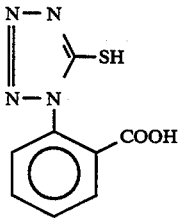
(20)
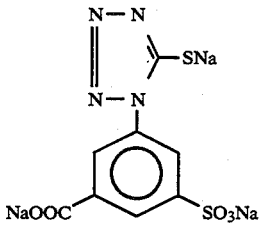
(21)
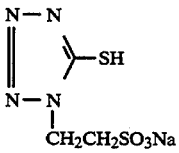
-continued
(22)
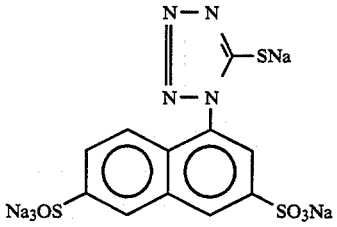
(23)
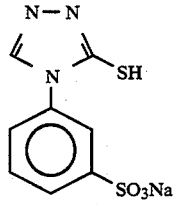
(24)
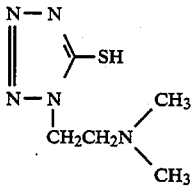
(25)
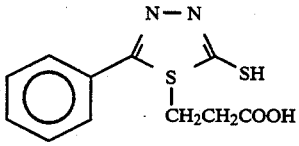
(26)
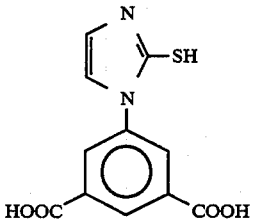
(27)
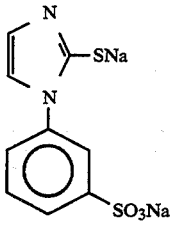
(28)
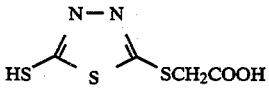
(29)
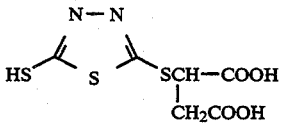
(30)
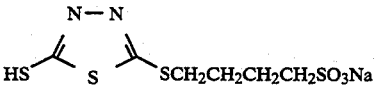

-continued (31)

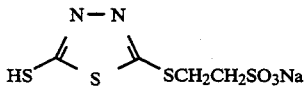

(32)

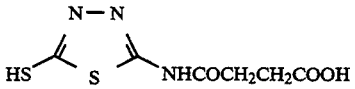

(33)

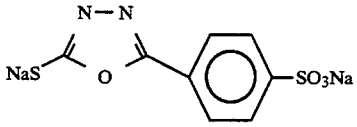

(34)

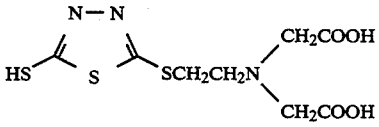

(35)

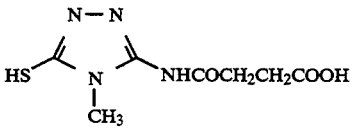

(36)

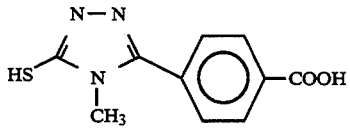

(37)

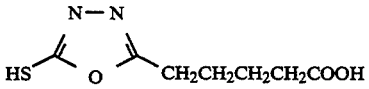

(38)

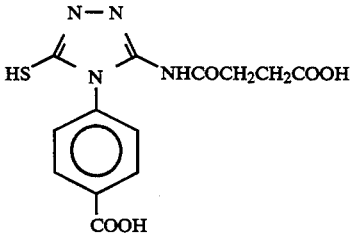

(39)

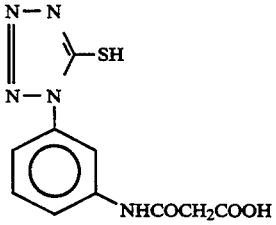

The compounds represented by the general formula (A) are known and can be synthesized by any suitable method as described in U.S. Pat. Nos. 2,585,388 2,541,924, and 3,017,270, JP-B-42-21842 and JP-B-49-8334 (the term "JP-B" as used herein means an "examined Japanese patent publication"), JP-A-53-50169, JP-A-55-59463, JP-A-50-89034, JP-A-53-28426, JP-A-55-21007, and JP-A-40-28496, British Patents 1,275,701, and 940,169, D. A. Berges et. al., "Journal of the Heterocyclic Chemistry", vol. 15, No. 981, 1978, "The Chemistry of Heterocyclic Chemistry", Imidazole and Derivatives part I, pp. 336–339, Chemical Abstract, 58, 7921 (1963), page 394, E. Hoggarth, "Journal of Chemical Society", pp. 1160–1167, 1949, S. R. Saudler, W. Karo, "Organic Functional Group Preparation", Academic Press, pp. 312–315, 1968, M. Chamdon, et. al., "Bulletin de la Societe Chimique de France", 723 (1954), D. A. Shirley, D. W. Alley, "Journal of the Americal Chemical Society", 79, 4922 (1954), A. Whol, "W. Marchwald, Ber.", vol. 22, page 568 (1889), Journal of Americal Society, 44, pp. 1502–1510, "Advanced in Heterocyclic Chemistry", 9, pp. 165–209 (1968), West German Patent 2,716,707, "The Chemistry of Heterocyclic Compounds Imidazole and Derivatives", vol. 1, page 384, "Organic Synthesis IV", page 569 (1963), Bre., 9, 465(1976), and "Journal of American Society", 45, 2390 (1923).

The compounds represented by the general formula (A) may be incorporated in a silver halide emulsion layer or hydrophilic colloidal layer (e.g., interlayer, surface protective layer, yellow filter layer, antihalation layer).

Preferably, the compounds represented by the general formula (A) are incorporated in the silver halide emulsion layer or its adjacent layers.

The amount of the compounds represented by the general formula (A) to be incorporated in these layers is in the range of $1\times10^{-7}$ to $1\times10^{-3}$ mol/m$^2$, preferably $5\times10^{-7}$ to $1\times10^{-4}$ mol/m$^2$, more preferably $1\times10^{-6}$ to $1\times10^{-5}$ mol/m$^2$.

The above mentioned emulsion of the present invention is preferably a monodisperse emulsion.

The monodisperse emulsion as defined herein is an emulsion having a grain diameter distribution wherein the grain diameter variation coefficient of silver halide grains is 0.25 or less. The grain diameter variation coefficient is obtained by dividing the standard deviation of grain diameters by the average grain diameter. In other words, assuming that the emulsion grains each has a diameter ri and the number of the emulsion grains is ni, the average grain diameter can be defined by the following equation:

$$\bar{r} = \frac{\Sigma ni \cdot ri}{\Sigma ni}$$

($\bar{r}$ represents an average grain diameter)

The standard deviation of grain diameters can be defined by the following equation:

$$S = \sqrt{\frac{\Sigma(\bar{r} - ri)^2 \cdot ni}{\Sigma ni}}$$

(S represents a standard deviation of grain diameters)

The individual grain diameter as defined herein is a diameter calculated in terms of a projected area obtained by microphotography (normally electron microphotography) well known in the art as described in T. H. James, "The Theory of the Photographic Process", 3rd, ed., pp. 36–43, Macmillan, 1966. The diameter value is defined as the diameter of the circle having the same area as the projected area of the silver halide grain as described in the above cited reference. Accordingly, even if the shape of the silver halide grain is other than a sphere (e.g., cube, octahedron, tetradecahedron, tablet, potato-like form), the average grain diameter r and its standard deviation S can be similarly determined.

The grain diameter variation coefficient of silver halide grains is in the range of 0.25 or less, preferably 0.20 or less, more preferably 0.15 or less.

A single emulsion of the present invention may be incorporated in the light-sensitive emulsion layer. Alternatively, two or more emulsions of the present invention having different average grain sizes may be used in combination. If two or more emulsions are used, they may be incorporated in different layers, but preferably are incorporated in the same light-sensitive layer in admixture. Further, if two or more emulsions are used, some of these emulsions may have a silver iodide content and layer structure as defined herein and the others may not. The use of such a mixture of emulsions is preferred in the light of control over gradation, control over graininess in the range from low exposure to high exposure, and control over color development dependence (e.g., dependence on time, composition of developer such as color developing agent and sodium sulfite, pH).

The present photographic light-sensitive material can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers including a plurality of silver halide emulsion layers having substantially the same color sensitivity and different light sensitivities on a support. The light-sensitive layers are unit light-sensitive layers having a color sensitivity to any of blue light, green light and red light. In the multilayer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor as commonly used.

The plurality of silver halide emulsion layers constituting each unit light-sensitive layer can preferably be in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remote from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932 (the term "JP-B" as used herein means an "examined Japanese patent publication"), a blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order remote from the support in a color-sensitive layer as described in JP-A-59-2024643.

Alternatively, a high sensitivity emulsion layer, a low sensitivity emulsion layer and a middle sensitivity emulsion layer or a low sensitivity emulsion layer, a middle sensitivity emulsion layer and a high sensitivity emulsion layer may be arranged in this order. In the case of four-layer structure, too, the arrangement of layers may be similarly altered.

In order to improve color reproducibility, a donor layer (CL) having an interimage effect and a different spectral sensitivity distribution from the main light-sensitive layers such as BL, GL and RL may be provided adjacent or close to these main layers as described in U.S. Pat. Nos. 4,663,271, 4,705,744, and 4,707,436, and JP-A-62-160448 and JP-A-63-89580.

As described above, various layer structures and arrangements can be selected depending on the purpose of the light-sensitive material.

A suitable silver halide to be incorporated in the photographic emulsion layer in the photographic light-sensitive material to be used in the present invention is silver iodobromide, silver iodochloride or silver iodochlorobromide containing silver iodide in an amount of about 30 mol % or less. Particularly suitable is silver iodobromide or silver iodochlorobromide containing silver iodide in an amount of about 2 mol % to about 25 mol %.

Silver halide grains in the photographic emulsions may be so-called regular grains having a regular crystal form, such as cube, octahedron and tetradecahedron, or those having an irregular crystal form such as sphere and tablet, those having a crystal defect such as twinning plane, or those having a combination of these crystal forms.

The silver halide grains may be either fine grains of about 0.2 μm or smaller in diameter or giant grains having a projected area diameter or up to about 10 μm, preferably fine grains having a diameter of 0.1 to 0.2

μm. The emulsion may be either a monodisperse emulsion or a polydisperse emulsion.

The preparation of the silver halide photographic emulsion which can be used in the present invention can be accomplished by any suitable method as described in *Research Disclosure* No. 17643 (December 1978), pp. 22–23, "I. Emulsion Preparation and Types", No. 18716 (November 1979), page 648, and No. 307105 (November 1989), pp. 863–865, Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion Focal Press", 1964.

Furthermore, monodisperse emulsions as described in U.S. Pat. Nos. 3,574,628 and 3,655,394, and British Patent 1,413,748 can preferably be used in the present invention.

Tabular grains having an aspect ratio of about 5 or more can be used in the present invention. The preparation of such tabular grains can easily be accomplished by any suitable method as described in Gutoff, "Photographic Science and Engineering", vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc. by an epitaxial junction. Mixtures of grains having various crystal forms may also be used.

The above mentioned emulsion may be of the surface latent image type in which latent images are mainly formed on the surface of grains or the internal latent image type in which latent images are mainly formed inside the grains or the type in which latent images are formed both on the surface and inside the grains. The emulsion needs to be a negative type emulsion. If the emulsion is of the internal latent image type, it may be a core/shell type internal latent image emulsion as disclosed in JP-A-63-264740. A process for the preparation of such a core/shell type internal latent image emulsion is described in JP-A-59-133542. In this emulsion, the thickness of the shell depends on development process, etc. and is preferably in the range of 3 to 40 nm, particularly 5 to 20 nm.

The silver halide emulsion to be used in the present invention is normally subjected to physical ripening, chemical ripening and spectral sensitization. Additives to be used in these steps are described in *Research Disclosure* Nos. 17643, 18716 and 307105 as tabulated below.

In the light-sensitive material of the present invention, two or more kinds of light-sensitive silver halide emulsions which are different in at least one of grain size, grain size distribution, halogen composition, grain shape and sensitivity may be incorporated in the same layer in admixture.

Surface-fogged silver halide grains as disclosed in U.S. Pat. No. 4,082,553, internally-fogged silver halide grains as described in U.S. Pat. No. 4,626,498 and JP-A-59-214852, or colloidal silver may preferably be incorporated in a light-sensitive silver halide emulsion layer and/or substantially light-insensitive hydrophilic colloidal layer. The term "internally- or surface-fogged silver halide grains" as used herein means "silver halide grains which can be uniformly (nonimagewise) developed regardless of whether they are present in the exposed portion or unexposed portion on the light-sensitive material". Processes for the preparation of internally- or surface-fogged silver halide grains are described in U.S. Pat. No. 4,626,498, and JP-A-59-214852.

Silver halides forming the core of internally-fogged core/shell type silver halide grains may have the same or different halogen compositions. Internally- or surface-fogged silver halide grains may comprise any of silver chloride, silver chlorobromide, silver iodobromide and silver chloroiodobromide. The size of these fogged silver halide grains is not specifically limited, and its average grain size is preferably in the range of 0.01 to 0.75 μm, particularly 0.05 to 0.6 μm. The crystal form of these grains is not specifically limited and may be regular. These emulsions may be polydisperse but is preferably monodisperse (silver halide grains at least 95% by weight or number of which are those having grain diameters falling within ±40% from the average grain size).

In the present invention, light-insensitive finely divided silver halide grains are preferably used. Light-insensitive finely divided silver halide grains are silver halide grains which are not exposed to light upon imagewise exposure for forming dye images so that they are not substantially developed in the development process. Preferably, these silver halide grains are not previously fogged.

These finely divided silver halide grains have a silver bromide content of 0 to 100 mol % and may optionally contain silver chloride and/or silver iodide, preferably 0.5 to 10 mol % of silver iodide.

These finely divided silver halide grains preferably have an average diameter of 0.01 to 0.5 μm, more preferably 0.02 to 0.2 μm as calculated in terms of a diameter of a circle having the same area as the projected area of grain.

These finely divided silver halide grains can be prepared in the same manner as ordinary light-sensitive silver halide. In this case, the surface of the silver halide grains do not need to be either optically or spectrally sensitized. However, prior to the addition of the emulsion to a coating solution, a known additive such as a triazole, azaindene, benzothiazolium or mercapto compound and zinc compound is preferably added to the emulsion. Colloidal silver is preferably incorporated in the layer containing these finely divided silver halide grains.

The coated amount of silver in the light-sensitive material of the present invention is preferably in the range of 6.0 g/m$^2$ or less, most preferably 4.5 g/m$^2$ or less.

Known photographic additives which can be used in the present invention are also described in the above cited three Research Disclosures as tabulated below.

| Kind of additive | RD17643 | RD18716 | RD307105 |
|---|---|---|---|
| 1. Chemical sensitizer | p. 23 | p. 648 right column (RC) | p. 866 |
| 2. Sensitivity increasing agent | | p. 648 right column (RC) | |
| 3. Spectral sensitizer and supersensitizer | pp. 23–24 | p. 648 RC–p. 649 RC | pp.866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, | pp. 25–26 | p. 649 RC–p. 650 LC | p. 873 |

-continued

| Kind of additive | RD17643 | RD18716 | RD307105 |
|---|---|---|---|
| and ultraviolet absorbent | | | |
| 7. Stain inhibitor | p. 25 RC | p. 650 LC–RC | p. 872 |
| 8. Dye image stabilizer | p. 25 | p. 650 LC | do. |
| 9. Hardening agent | p. 26 | p. 651 LC | pp. 874–875 |
| 10. Binder | p. 26 | p. 650 LC | pp. 873-874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14. Matting agent | | | pp. 878–879 |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

The light-sensitive material of the present invention preferably comprises a mercapto compound as disclosed in U.S. Pat. Nos. 4,740,454, and 4,788,132, and JP-A-62-18539, and JP-A-1-283551.

The light-sensitive material of the present invention preferably comprises a fogging agent, a development accelerator, a silver halide solvent or a compound for releasing precursors thereof as disclosed in JP-A-1-106052 regardless of the amount of developed silver produced by development.

The light-sensitive material of the present invention preferably comprises a dye which has been dispersed by a method as disclosed in International Patent Disclosure WO88/04794 and JP-A-1-502912 or a dye as disclosed in EP317,308, U.S. Pat. No. 4,420,555, and JP-A-1-259358.

The light-sensitive material to be processed in the present invention can comprise various color couplers. Specific examples of the color couplers are described in the patents described in the above cited Research Disclosure No. 17643, VII-C to G, and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739 (the term "JP-B" as used herein means an "examined Japanese patent publication"), British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,067, 4,500,630, 4,540,654, and 4,556,630, European Patent 73,636, JP-A-60-33552, JP-A-60-43659, JP-A-61-72238, JP-A-60-35730, JP-A-55-118034, and JP-A-60-185951, RD Nos. 24220 (June 1984) and 24230 (June 1984), and WO88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Disclosure No. 3,329,729, European Patents 121,365A and 249,453A, and JP-A-61 -42658. Further, pyrazoloazole couplers as disclosed in JP-A-64-553, JP-A-64-554, JP-A-64-555, and JP-A-64-556 and imidazole couplers as disclosed in U.S. Pat. No. 4,818,672 can be used.

Typical examples of polymerized dye-forming couplers are described in U.S. Pat. Nos. 3,451,820, 4,080,211, 4,367,282, 4,409,320, and 4,576,910, British Patent 2,102,137, and European Patent 341,188A.

Couplers which form a dye having moderate diffusibility preferably include those described in U.S. Pat. No. 4,366,237, British Patent 2,125,570, European Patent 96,570, and West German Patent Publication No. 3,234,533.

Colored couplers for correction of unnecessary absorptions of the developed dye preferably include those described in *Research Disclosure* No. 17643, VII-G, *Research Disclosure* No. 307105, VII-G, U.S. Pat. Nos. 4,163,670, 4,004,929, and 4,138,258, JP-B-57-39413, and British Patent 1,146,368. Furthermore, couplers for correction of unnecessary absorption of the developed dye by a fluorescent dye released upon coupling as described in U.S. Pat. No. 4,774,181 and couplers containing as a separatable group a dye precursor group capable of reacting with a developing agent to form a dye as described in U.S. Pat. No. 4,777,120 can preferably be used.

Compounds capable of releasing a photographically useful residual upon coupling can also be used in the present invention. Preferred examples of DIR couplers which release a developing inhibitor are described in the patents cited in RD 17643, VII-F, JP-A-57-151944, JP-A-57-154234, JP-A-60-184248, JP-A-63-37346, and JP-A-63-37350, and U.S. Pat. Nos. 4,248,962, and 4,782,012.

Bleach accelerator-releasing couplers as disclosed in RD Nos. 11449, and 24241, and JP-A-61-201247 are effective for the reduction of time required for a processing step having bleaching capability. In particular, when incorporated in a light-sensitive material comprising the above mentioned tabular silver halide grains, these couplers exhibit their maximum effect.

Couplers capable of imagewise releasing a nucleating agent or a developing accelerator at the time of development preferably include those described in British Patents 2,097,140 and 2,131,188, and JP-A-59-157638 and JP-A-59-170840. Further, compounds which undergo a redox reaction with the oxidation product of a developing agent to release a fogging agent, a development accelerator, a silver halide solvent or the like as disclosed in JP-A-60-107029, JP-A-60-252340, JP-A-1-44940, and JP-A-1-45687 are preferred.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compounds or DIR couplers or DIR coupler-releasing couplers as described in JP-A-60-185950 and JP-A-62-24252, couplers capable of releasing a dye which returns to its original color after release as described in European Patents 173,302A and 313,308A, couplers capable of releasing a ligand as described in U.S. Pat. No. 4,553,477, couplers capable of releasing a leuco dye as described in JP-A-63-75747, and couplers capable of releasing a fluorescent dye as described in U.S. Pat. No. 4,774,181.

The incorporation of the couplers of the present invention in the light-sensitive material can be accomplished by any suitable known dispersion method.

Examples of high boiling solvents to be used in the oil-in-water dispersion process are described in U.S. Pat. No. 2,322,027. Specific examples of high boiling organic solvents having a boiling point of 175° C. or higher at normal pressure which can be used in the oil-in-water dispersion process include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tertamylphenol), aliphatic carboxylic esters (e.g., bis(2-ethylhexyl)sebacate, dioctyl azerate, glycerol tributylate, isostearyl lactate, trioctyl citrate), aniline derivatives (e.g., N,N-di-butyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of a latex dispersion method and specific examples of latexes to be used in dipping are described in U.S. Pat. No. 4,199,363, West German Patent Application (OLS) 2,541,274, and 2,541,230.

The color light-sensitive material of the present invention preferably comprises various antiseptics or antifungal agents such as phenetyl alcohol and 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole as described in JP-A-63-257747, JP-A-62-272248and JP-A-1-80941.

The present invention is applicable to various types of color light-sensitive materials, particularly preferably to color negative films for common use or motion picture, color reversal films for slide or television, color papers, color positive films and color reversal papers.

Suitable supports which can be used in the present invention are described in the above cited RD 17643 (page 28), No. 18716 (right column on page 647 to left column on page 648), and No. 307105 (page 897).

In the present light-sensitive material, the total thickness of all hydrophilic colloidal layers on the emulsion side is preferably in the range of 28 μm or less, more preferably 23 μm or less, further preferably 18 μm, particularly 16 μm. The film swelling $T_{\frac{1}{2}}$ is preferably in the range of 30 seconds or less, more preferably 20 seconds or less. In the present invention, the film thickness is determined after being stored at a temperature of 25° C. and a relative humidity of 55% for 2 days. The film swelling $T_{\frac{1}{2}}$ can be determined by a method known in the art, e.g., by means of a swellometer of the type as described in A. Green et al, "Photographic Science and Engineering", vol. 19 No. 2, pp. 124–129. $T_{\frac{1}{2}}$ is defined as the time taken until half the saturated film thickness is reached wherein the saturated film thickness is 90% of the maximum swollen film thickness reached when the light-sensitive material is processed with a color developer at a temperature of 30° C. over 195 seconds.

The film swelling $T_{\frac{1}{2}}$ can be adjusted by adding a film hardener to gelatin which is used as a binder or altering the aging condition after coating. The percentage swelling of the light-sensitive material is preferably in the range of 150 to 400%. The percentage swelling can be calculated from the maximum swollen film thickness determined as described above in accordance with the equation: (maximum swollen film thickness − film thickness)/film thickness.

The light-sensitive material of the present invention preferably comprises a hydrophilic colloidal layer (hereinafter referred to as "back layer") having a total dried thickness of 2 μm to 20 μm on the side other than the emulsion layer side. The back layer preferably contains the above mentioned light absorbent, filter dye, ultraviolet absorbent, antistatic agent, film hardener, binder, plasticizer, lubricant, coating aid, surface active agent, etc. The back layer preferably exhibits a percentage swelling of 150 to 500%.

The color photographic light-sensitive material according to the present invention can be developed in accordance with an ordinary method as described in RD Nos. 17643 (pp. 28–29), 18716 (left column—right column on page 651) and 30710 (pp. 880–881).

The color developer to be used in the development of the present light-sensitive material is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylaniline, and sulfates, hydrochlorides and p-toluenesulfonates thereof. Particularly preferred among these compounds is 3-methyl-4-amino-N-ethyl-N-β-hydroxyethylaniline sulfate. These compounds can be used in combination of two or more thereof depending on the purpose of application.

The color developer normally contains a pH buffer such as a carbonate and a phosphate of an alkaline metal or a development inhibitor or fog inhibitor such as bromides, iodides, benzimidazoles, benzothiazoles and mercapto compounds. If desired, the color developer may further contain various preservatives such as hydroxylamine, diethylhydroxylamine, sulfites, hydrazines (e.g., N,N-biscarboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphoric acids, alkylphosphonic acids, and phosphonocarboxylic acids, (e.g., ethylenediaminetetraacetic acid, nitrilotriacetic acid, diethylenetriaminepentaacetic acid, cyclohexanediaminetetraacetic acid, hydroxyethyliminoacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof).

Reversal processing is usually carried out by black-and-white development followed by color development. Black-and-white developers to be used can contain one or more of the known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol. The color developer or black-and-white developer usually has a pH from 9 to 12. The replenishment rate of the developer is usually 3 l or less per $m^2$ of the light-sensitive material, though this depends on the type of the color photographic material to be processed. The replenishment rate may be reduced to 500 ml/$m^2$ or less by decreasing the bromide ion concentration in the replenisher. If the replenishment rate is reduced, the area of the processing tank in contact with air is preferably reduced to inhibit the evaporation and air oxidation of the processing solution.

The area of the photographic processing solution in contact with air in the processing tank can be represented by an opening value as defined by the following equation:

$$\text{Opening value} = \frac{[\text{area of processing solution in contact with air } (cm^2)]}{[\text{volume of processing solution } (cm^3)]}$$

The opening value as defined above is preferably in the range of 0.1 or less, more preferably 0.001 to 0.05. Examples of methods for reducing the opening value include a method which comprises putting a cover such as a floating lid on the surface of the processing solution in the processing tank, a method as disclosed in JP-A-1-82033 utilizing a mobile lid, and a slit development method as disclosed in JP-A-63-216050. The reduction of the opening value is preferably effected in both color development and black-and-white development steps as well as all the subsequent steps such as bleach, blix, fixing, rinse and stabilization. The replenishment rate can also be reduced by a means for suppressing accumulation of the bromide ion in the developing solution.

The couplers of the present invention can also be emulsion-dispersed in an aqueous solution of hydrophilic colloid in the form of impregnation in a loadable latex polymer in the presence or absence of the above mentioned high boiling organic solvent or solution in a water-insoluble and organic solvent-soluble polymer.

Preferably, monopolymers or copolymers as described in International Patent Disclosure WO88/00723, pp. 12–13, may be used. In particular, acrylamide polymers may preferably be used in view of dye stability.

The color processing time is normally in the range of 2 to 5 minutes. The processing time can be further reduced by carrying out color development at an elevated temperature and a high pH value with a color developing solution containing a color developing agent in a high concentration.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron(III), peroxides, quinones, and nitro compounds. Typical examples of these bleaching agents are organic complex salts of iron(III), e.g., with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid-iron(III) complex salts such as (ethylenediaminetetraacetato)iron (III) complex salts and (1,3-diaminopropanetetraacetate)iron(III) complex salts are preferred in view of speeding up processing and conservation of the environment. In particular, aminopolycarboxylic acid-iron(III) complex salts are useful in both a bleaching solution and a blix solution. The pH value of a bleaching solution or blix solution comprising such aminopolycarboxylic acid-iron complex salts is normally in the range of 4.0 to 8. For speeding up processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patent 1,290,812, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and *Research Disclosure* No. 17129 (July 1978), thiazolidine derivatives as described in JP-A-50-140129, thiourea derivatives as described in U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A-49-40943, JP-A-49-59644, JP-A-53-94927, JP-A-54-35727, JP-A-55-26506, and JP-A-58-163940, and bromine ions. Preferred among these compounds are compounds containing a mercapto group or disulfide group because of their great accelerating effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, etc. are preferred.

Examples of fixing agents to be contained in the fixing solution or blix solution include thiosulfates, thiocyanates, thioethers, thioureas, and a large amount of iodides. The thiosulfates are normally used. In particular, ammonium thiosulfate can be most widely used. Further, thiosulfates are preferably used in combination with thiocyanates, thioether compounds, thioureas, etc. As preservatives for the fixing or blix bath there can be preferably used sulfites, bisulfites, carbonyl bisulfite adducts or sulfinic acid compounds as described in European Patent 294769A. The fixing solution or blix solution preferably contains aminopolycarboxylic acids or organic phosphonic chelating agents for the purpose of stabilizing the solution.

In the present invention, the fixing solution or blix solution preferably contains a compound with a pKa of 6.0 to 9.0, more preferably imidazoles such as imidazole, 1-methylimidazole, 1-ethylimidazole and 2-methylimidazole in an amount of 0.1 to 10 mol/l for the purpose of adjusting pH.

The total time required for the desilvering step is preferably as short as possible so long as poor desilvering does not occur. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into the emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A-60-191257, JP-A-60-191258, and JP-A-60-191259. Such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or direct-flow system), and other various factors. Of these factors, the relationship between the number of washing tanks and the quantity of water in a multistage counter-flow system can be obtained according to the method described in "Journal of the Society of Motion Picture and Television Engineers", vol. 64, pp. 248–253 (May 1955).

According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku" (1986), Eisei Gijutsu Gakkai (ed), "Biseibutsu no mekkin, sakkin, bobigijutsu" (1982), and Nippon Bokin Bobi Gakkai (ed), "Bokin bobizai jiten" (1986)

The washing water has a pH value from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques as described in JP-A-57-8543, JP-A-58-14834, and JP-A-60-220345 can be used.

The above-described washing step may be followed by stabilization in some cases. For example, a stabilizing bath containing a dye stabilizer and a surface active agent is used as a final bath for color light-sensitive materials for picture taking. Examples of such a dye stabilizer include aldehydes such as formalin and glutaraldehyde, N-methylol compounds, hexamethylenetetramine, and aldehyde-bisulfite adducts. This stabilizing bath may also contain various chelating agents and antifungal agents.

The overflow accompanying replenishment of the washing bath and/or stabilizing bath can be reused in other steps such as desilvering.

The silver halide color light-sensitive material of the present invention may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and *Research Disclosure* Nos. 14,850 and 15,159, and aldol compounds as described in *Research Disclosure* No. 13,924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature range is normally from 33° C. to 38° C. However, a higher temperature range can be used to accelerate processing, thereby reducing the processing time. On the contrary, a lower temperature range can be used to improve the picture quality or the stability of the processing solutions.

Further, the silver halide light-sensitive material of the present invention can also be applied to a heat-developable light-sensitive material as disclosed in U.S. Pat. No. 4,500,626, JP-A-60-133449, JP-A-59-218443, and JP-A-61-238056, and European Patent 210,660A2.

The present invention will be further described in the following examples, but the present invention should not be construed as being limited thereto.

EXAMPLE 1

Preparation of Emulsion 150 cc of an aqueous solution of 5.0 g of silver nitrate was momentarily added to an aqueous solution of 20 g of inactive gelatin, 2.4 g of potassium bromide and 2.05 g of potassium iodide while the latter was stirred at a temperature of 58° C. Excess potassium bromide was further added to the system. The system was then subjected to physical ripening for 20 minutes. 0.2 mol/l, 0.67 mol/l and 2 mol/l aqueous solutions of silver nitrate and halogenated potassium (mixture of 58 mol % of potassium bromide and 42 mol % of potassium iodide) were each added to the system at a flow rate of 10 cc/min. in accordance with the method as described in U.S. Pat. No. 4,242,445 to allow 42 mol % silver iodobromide grains to grow. For desilvering, the system was washed with water to obtain Emulsion a. The yield of Emulsion a was 900 g. Emulsion a comprised silver halide grains with an average size of 0.61 μm. Emulsions b, c, d and e with a silver iodide content of 42 mol % and an average grain size of 0.59 μm, 0.56 μm, 0.52 μm, and 0.46 μm, respectively, were prepared in the same manner as Emulsion a.

300 g of Emulsion a was measured out. To the material were added 850 cc of distilled water and 30 cc of 10% potassium bromide. The mixture was heated to a temperature of 70° C. with stirring. To the material was added 0.02 g of Compound (18). 300 cc of an aqueous solution containing 33 g of silver nitrate and 320 cc of an aqueous solution containing 25 g of potassium bromide were simultaneously added to the system in 40 minutes while the pAg value thereof was kept at 8.0. Further, 800 cc of an aqueous solution containing 100 g of silver nitrate and 860 cc of an aqueous solution containing 75 g of potassium bromide were simultaneously added to the system in 60 minutes. Thus, a silver iodobromide emulsion 1 with a silver iodide content of 14 mol % and an average grain size of 0.88 μm was prepared. Emulsion 1 comprised twinning grains with an aspect ratio of 2.0 and 111 plane proportion of 80%. 300 g of Emulsion b was measured out and then provided with a shell of a total of 125 g of silver nitrate in the same manner as Emulsion 1. Thus, a silver bromoiodide emulsion 2 with a silver iodide content of 12 mol % was prepared. Similarly, Emulsions 3 to 5 were prepared.

Emulsions 6 to 9 were prepared in the same manner as Emulsions 1 to 4, respectively, except that the conditions under which the shell was provided were altered to 60° C. and pAg value of 9.0 and Compound (18) was not used.

Emulsion 10 was prepared from 133 g of Emulsion b, 167 g of Emulsion d and 300 g of Emulsion c in the same manner as Emulsion 3. Emulsion 11 was prepared from 50 g of Emulsion a, 50 g of Emulsion d, 200 g of Emulsion b and 300 g of Emulsion c in the same manner as Emulsion 3. Emulsion 12 and Emulsion 13 were prepared in the same manner as Emulsion 1 and Emulsion 4, respectively, except that Compound (18) was not used and the pAg value was altered to 7.5. Similarly, a silver iodobromide Emulsion f with an average grain size of 0.82 μm and a silver iodide content of 14 mol % was prepared. The emulsion was provided with a shell of pure silver bromide to prepare Emulsion 14. The properties of these emulsions were tabulated below:

TABLE 1

| Emulsion No. | Silver iodide content in formulation (mol %) Core | Shell | Core/shell ratio (Ag molar ratio) | Average silver iodide content (mol %) | Definite layer structure | Average grain diameter (μm) | Grain diameter fluctuation coefficient | Aspect ratio | Compound of the general formula (A) |
|---|---|---|---|---|---|---|---|---|---|
| 1 | 42 | 0 | 1/2 | 14.0 | YES | 0.88 | 0.20 | 2.0 | (18) |
| 2 | 42 | 0 | 1/2.5 | 12.0 | " | 0.86 | 0.19 | 1.9 | " |
| 3 | 42 | 0 | 1/3.2 | 10.0 | " | 0.86 | 0.19 | 1.9 | " |
| 4 | 42 | 0 | 1/4 | 8.4 | " | 0.88 | 0.18 | 1.8 | " |
| 5 | 42 | 0 | 1/6 | 6.0 | " | 0.87 | 0.18 | 1.6 | " |
| 6 | 42 | 0 | 1/2 | 14.0 | NO | 0.89 | 0.21 | 2.2 | — |
| 7 | 42 | 0 | 1/2.5 | 12.0 | " | 0.87 | 0.20 | 2.0 | — |
| 8 | 42 | 0 | 1/3.2 | 10.0 | " | 0.86 | 0.20 | 2.0 | — |
| 9 | 42 | 0 | 1/4 | 8.4 | " | 0.87 | 0.19 | 1.9 | — |
| 10 | 42 | 0 | 1/3.2 | 10.0 | YES | 0.87 | 0.22 | 2.0 | (18) |
| 11 | 42 | 0 | 1/3.2 | 10.0 | " | 0.87 | 0.27 | 2.2 | " |
| 12 | 42 | 0 | 1/2 | 14.0 | " | 0.89 | 0.21 | 1.9 | — |
| 13 | 42 | 0 | 1/3.2 | 10.0 | " | 0.88 | 0.21 | 1.8 | — |
| 14 | 14 | 0 | 4/1 | 11.2 | NO | 0.88 | 0.18 | 2.1 | (18) |

A multilayer color light-sensitive material was prepared as Sample 101 by coating on an undercoated cellulose triacetate film support with various layers having the following compositions.

Composition of Light-Sensitive Layer

The coated amount of silver halide and colloidal silver is represented in g/m² as calculated in terms of an amount of silver. The coated amount of coupler, additive and gelatin is represented in g/m². The coated amount of sensitizing dye is represented in mol per mol of silver halide contained in the same layer.

| | |
|---|---|
| 1st Layer: anti-halation layer | |
| Black colloidal silver | 0.15 |
| Gelatin | 0.90 |
| ExM-1 | $5.0 \times 10^{-3}$ |
| 2nd Layer: interlayer | |
| Gelatin | 0.60 |
| UV-1 | $3.0 \times 10^{-2}$ |

-continued

| | |
|---|---|
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| 3rd layer: low sensitivity red-sensitive emulsion layer | |
| Silver iodobromide emulsion (silver iodide content: 2 mol %; internal high AgI type; grain diameter: 0.3 μm as calculated in terms of sphere; coefficient of fluctuation in grain diameter: 29% as calculated in terms of sphere; mixture of normal crystal and twin crystal; diameter/thickness ratio: 2.5) | 0.50 |
| Gelatin | 1.50 |
| ExS-1 | $1.0 \times 10^{-4}$ |
| ExS-2 | $3.0 \times 10^{-4}$ |
| ExS-3 | $1 \times 10^{-5}$ |
| ExC-1 | 0.11 |
| ExC-3 | 0.11 |
| ExC-4 | $3.0 \times 10^{-2}$ |
| ExC-7 | $1.0 \times 10^{-2}$ |
| Solv-1 | $7.0 \times 10^{-3}$ |
| 4th Layer: middle sensitivity red-sensitive emulsion layer | |
| Silver iodobromide emulsion (silver iodide content: 4 mol %; internal high AgI type; grain diameter: 0.55 μm as calculated in terms of sphere; coefficient of fluctuation in grain diameter: 20% as calculated in terms of sphere; mixture of normal crystal and twin crystal; diameter/thickness ratio: 1.0) | 0.85 |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Cpd-10 | $1.0 \times 10^{-4}$ |
| Solv-1 | 0.10 |
| 5th Layer: high sensitivity red-sensitive emulsion layer | |
| Silver iodobromide emulsion (silver iodide content: 7 mol %; internal high AgI type; grain diameter: 0.6 μm as calculated in terms of sphere; coefficient of fluctuation in grain diameter: 19% as calculated in terms of sphere; mixture of twin crystals; diameter/thickness ratio: 5.5) | 0.70 |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| ExC-7 | $1.5 \times 10^{-2}$ |
| Solv-1 | 0.15 |
| Solv-2 | $8.0 \times 10^{-2}$ |
| 6th Layer: interlayer | |
| Gelatin | 0.50 |
| P-2 | 0.17 |
| Cpd-1 | 0.10 |
| Cpd-4 | 0.17 |
| Solv-1 | $5.0 \times 10^{-2}$ |
| 7th Layer: low sensitivity green-sensitive emulsion layer | |
| Silver iodobromide emulsion (silver iodide content: 2 mol %; internal high AgI type; grain diameter: 0.3 μm as calculated in terms of sphere; coefficient of fluctuation in grain diameter: 28% as calculated in terms of sphere; twin crystal; diameter/thickness ratio: 2.5) | 0.30 |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-3}$ |
| Solv-1 | 0.20 |
| 8th Layer: middle sensitivity green-sensitive emulsion layer | |
| Silver iodobromide emulsion (silver iodide content: 4 mol %; internal high AgI type; grain diameter: 0.55 μm as calculated in terms of sphere; coefficient of fluctuation in grain diameter: 20% as calculated in terms of sphere; mixture of normal crystal and twin crystal; diameter/thickness ratio: 4.0) | 0.70 |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-1 | $3.0 \times 10^{-2}$ |
| ExM-2 | 0.25 |
| ExM-3 | $1.5 \times 10^{-2}$ |
| ExY-1 | $4.0 \times 10^{-2}$ |
| Cpd-11 | $9.0 \times 10^{-3}$ |
| Solv-1 | 0.20 |
| 9th Layer: high sensitivity green-sensitive emulsion layer | |
| Silver iodobromide emulsion (silver iodide content: 7 mol %; internal high AgI type; grain diameter: 0.6 μm as calculated in terms of sphere; coefficient of fluctuation in grain diameter: 19% as calculated in terms of sphere; twin crystal; diameter/thickness ratio: 5.5) | 0.50 |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| 10th Layer: yellow filter layer layer | |
| Gelatin | 0.50 |
| Yellow colloidal silver | $5.0 \times 10^{-2}$ |
| Cpd-1 | 0.20 |
| Solv-1 | 0.15 |
| 11th Layer: low sensitivity blue-sensitive emulsion layer | |
| Silver iodobromide emulsion (silver iodide content: 4 mol %; internal high AgI type; grain diameter: 0.5 μm as calculated in terms of sphere; coefficient of fluctuation in grain diameter: 15% as calculated in terms of sphere; octahedral grain) | 0.50 |
| Gelatin | 1.00 |
| ExS-8 | $2.0 \times 10^{-4}$ |
| ExY-1 | 0.013 |
| ExY-3 | 0.90 |
| Cpd-2 | $1.0 \times 10^{-2}$ |
| Solv-1 | 0.30 |
| 12th Layer: high sensitivity blue-sensitive emulsion layer | |
| Emulsion 1 | 0.50 |

-continued

| | |
|---|---|
| Gelatin | 0.60 |
| ExS-8 | $1.0 \times 10^{-4}$ |
| ExY-1 | 0.012 |
| ExY-3 | 0.12 |
| Cpd-2 | $1.0 \times 10^{-3}$ |
| Solv-1 | $4.0 \times 10^{-2}$ |
| 13th Layer: 1st protective layer | |
| Finely divided silver iodobromide emulsion (average grain diameter: 0.07 μm; AgI content: 1 mol %) | 0.20 |
| Gelatin | 0.50 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| 14th Layer: 2nd protective layer | |
| Gelatin | 0.40 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

Furthermore, in order to improve preservability, processability, pressure resistance, antifungal and antibacterial properties, antistatic properties, and coatability, the following Cpd-3, Cpd-5, Cpd-6, Cpd-7, Cpd-8, P-1, W-1, W-2, and W-3 were added to the system.

Besides the above materials, n-butyl p-hydroxybenzoate was added to the system. Moreover, B-4, F-1, F-4, F-5, F-6, F-7, F-8, F-9, F-10, F-11, and iron salts, lead salts, gold salts, platinum salts, iridium salts, and rhodium salts were incorporated therein.

Samples 102 to 113

Samples 102 to 113 were prepared in the same manner as Sample 101 except that Emulsion 1 to be incorporated in the 12th layer was replaced by Emulsions 2 to 13, respectively.

Samples 114 to 126

Samples 114 to 126 were prepared in the same manner as Samples 101 to 113, respectively, except that Coupler ExY-1 to be incorporated in the 4th, 7th, 8th, 11th and 12th layers were replaced by Coupler (4) of the present invention in amounts of 1.2 molar times.

Samples 127 and 128

Samples 127 and 128 were prepared in the same manner as Sample 114 except that the half of Emulsion 1 to be incorporated in the 12th layer was replaced by Emulsion 3 and Emulsion 5, respectively.

Sample 129

Sample 129 was prepared in the same manner as Sample 114 except that Emulsion 1 to be incorporated in the 12th layer was replaced by Emulsion 14.

These samples were imagewise exposed to white light, and then subjected to the following color development. The relative sensitivity was determined as the relative value of the logarithm of the reciprocal of the exposure which gives a yellow density (fog+0.3). The gradient g of the straight line between the point (fog+0.3) and the point (fog+1.3) was determined. The results are set forth in Tables 2 and 3 along with the RMS value (determined for the yellow image obtained through a 48 μm diameter aperture) showing graininess.

For evaluation of sharpness, a similar processing was used, and a commonly used MTF method was used for measurement. Further, these samples were subjected to uniform exposure to green light with 1 lux·sec, imagewise exposed to blue light, and then subjected to the following color development. The color stain value was determined by subtracting the magenta density at yellow fog density from the magenta density at the exposure at which the yellow density gives a density of (fog+1.0). The results are set forth in Tables 2 and 3.

These samples which had been processed were allowed to stand at a temperature of 60° C. and a relative humidity of 70% for 2 weeks, and then measured for density again. The reduction in the yellow density from the initial yellow density of 2.5 was determined as dye stability. The results are set forth in Tables 2 and 3.

Another batch of these samples were imagewise exposed to white light in the same manner as described above, allowed to stand at a temperature of 50° C. and a relative humidity of 60% for 7 days, developed, and then measured for sensitivity. The change in the sensitivity from the initial value is set forth in Tables 2 and 3.

The color development was effected by means of an automatic developing machine in accordance with the following steps (until the accumulated replenishment of the solution reached three times the capacity of the running solution tank):

| Processing step | | | | |
|---|---|---|---|---|
| Step | Time | Temperature | Replenishment rate | Tank capacity |
| Color development | 2 min. 45 sec. | 38° C. | 45 ml | 10 l |
| Bleach | 1 min. 00 sec. | 38° C. | 20 ml | 4 l |
| Blix | 3 min. 15 sec. | 35° C. | 30 ml | 8 l |
| Washing (1) | 40 sec. | 35° C. | — | 4 l |
| Washing (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

* Determined per 35 mm width and 1 m length

** The washing step was effected in a counter-current process wherein the washing water flows backward.

The various processing solutions had the following compositions:

| | Running Solution | Replenisher |
|---|---|---|
| Color developer | | |
| Diethylenetriamine-pentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-[N-ethyl-N-(β-hydroxyethylamino]-2-methylaniline sulfate | 4.5 g | 5.5 g |
| Water to make | 1.0 l | 1.0 l |
| pH | 10.05 | 10.10 |
| Bleaching solution | | |
| Ferric ammonium ethylenediaminetetraacetate dihydrate | 120.0 g | Same as left |
| Disodium ethylenediaminetetraacetate | 10.0 g | " |
| Ammonium bromide | 100.0 g | " |
| Ammonium nitrate | 10.0 g | " |
| Bleach accelerator | 0.005 mol | " |

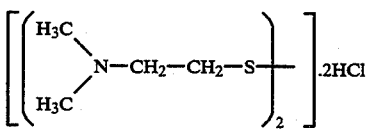

| | | |
|---|---|---|
| 27% Aqueous ammonia | 15.0 ml | " |

-continued

| | Running Solution | Replenisher |
|---|---|---|
| Water to make | 1.0 l | " |
| Blix solution | | |
| Ferric ammonium ethylenediaminetetraacetate dihydrate | 50 g | Same as left |
| Disodium ethylenediaminetetraacetate | 5.0 g | " |
| Sodium sulfite | 12.0 g | " |
| 70% Aqueous solution of ammonium thiosulfate | 240.0 ml | " |
| 27% Aqueous ammonia | 6.0 ml | " |
| Water to make | 1.0 l | " |
| pH | 7.2 | " |

Washing Solution (The running solution was also used as replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to7.5.

-continued

| | Stabilizing solution | |
|---|---|---|
| | Running Solution | Replenisher |
| 37% Formalin | 2.0 ml | Same as left |
| Polyoxyethylene-p-monononylphenylether mean polymerization degree: 10) | 0.3 g | do. |
| Disodium ethylenediaminetetraacetate | 0.05 g | do. |
| Water to make | 1.0 l | do. |
| pH | 5.0–8.0 | do. |

TABLE 2

| Sample | Coupler incorporated in 4th, 7th, 8th, 11th, 12th layers | Emulsion incorporated in 12th layer | Relative sensitivity | Gamma | RMS value[1)] × 1000 | MTF value[2)] | Color stain value | Dye stability (density drop) | Sensitivity change at 50° C., 60% |
|---|---|---|---|---|---|---|---|---|---|
| 101 (Comparative) | ExY-1 | 1 | 0.00 | 0.67 | 24.3 | 63 | 0.03 | 0.26 | 0.03 |
| 102 (Comparative) | " | 2 | 0.00 | 0.68 | 24.7 | 63 | 0.03 | 0.26 | 0.03 |
| 103 (Comparative) | " | 3 | 0.01 | 0.68 | 25.1 | 63 | 0.03 | 0.26 | 0.03 |
| 104 (Comparative) | " | 4 | 0.01 | 0.68 | 25.4 | 63 | 0.03 | 0.26 | 0.05 |
| 105 (Comparative) | " | 5 | 0.02 | 0.69 | 27.6 | 62 | 0.04 | 0.26 | 0.07 |
| 106 (Comparative) | " | 6 | −0.06 | 0.62 | 28.6 | 58 | 0.07 | 0.27 | 0.05 |
| 107 (Comparative) | " | 7 | −0.05 | 0.62 | 28.3 | 58 | 0.07 | 0.27 | 0.06 |
| 108 (Comparative) | " | 8 | −0.04 | 0.63 | 28.0 | 59 | 0.06 | 0.26 | 0.06 |
| 109 (Comparative) | " | 9 | −0.03 | 0.65 | 27.6 | 59 | 0.06 | 0.26 | 0.09 |
| 110 (Comparative) | " | 10 | 0.00 | 0.67 | 24.9 | 63 | 0.03 | 0.26 | 0.04 |
| 111 (Comparative) | " | 11 | −0.01 | 0.67 | 25.4 | 62 | 0.03 | 0.26 | 0.05 |
| 112 (Comparative) | " | 12 | −0.01 | 0.66 | 24.8 | 63 | 0.04 | 0.26 | 0.05 |
| 113 (Comparative) | " | 13 | −0.01 | 0.67 | 25.3 | 62 | 0.04 | 0.26 | 0.08 |
| 114 (Present Invention) | (4) | 1 | 0.01 | 0.67 | 23.7 | 65 | −0.01 | 0.04 | 0.01 |
| 115 (Present Invention) | " | 2 | 0.01 | 0.68 | 23.9 | 65 | −0.01 | 0.04 | 0.01 |
| 116 (Present Invention) | " | 3 | 0.02 | 0.68 | 24.1 | 65 | −0.01 | 0.04 | 0.01 |
| 117 (Present Invention) | " | 4 | 0.02 | 0.68 | 24.3 | 65 | −0.01 | 0.04 | 0.02 |
| 118 (Comparative) | " | 5 | 0.03 | 0.68 | 27.2 | 64 | 0.00 | 0.04 | 0.05 |
| 119 (Comparative) | " | 6 | −0.06 | 0.61 | 28.4 | 62 | 0.02 | 0.05 | 0.04 |
| 120 (Comparative) | " | 7 | −0.04 | 0.62 | 28.1 | 62 | 0.02 | 0.05 | 0.04 |
| 121 (Comparative) | " | 8 | −0.04 | 0.63 | 27.6 | 63 | 0.01 | 0.04 | 0.04 |
| 122 (Comparative) | " | 9 | −0.02 | 0.65 | 27.2 | 63 | 0.01 | 0.04 | 0.06 |
| 123 (Present Invention) | " | 10 | 0.01 | 0.67 | 24.3 | 65 | −0.01 | 0.04 | 0.02 |
| 124 (Present Invention) | " | 11 | −0.01 | 0.67 | 24.9 | 64 | −0.01 | 0.04 | 0.02 |
| 125 (Present Invention) | " | 12 | 0.00 | 0.66 | 24.1 | 65 | 0.00 | 0.04 | 0.02 |
| 126 (Present Invention) | " | 13 | −0.01 | 0.67 | 24.7 | 64 | 0.00 | 0.04 | 0.03 |
| 127 (Present Invention) | " | ⅓ | 0.01 | 0.68 | 23.9 | 65 | −0.01 | 0.04 | 0.01 |
| 128 (Present Invention) | " | 1/5 | 0.01 | 0.68 | 24.9 | 64 | 0.00 | 0.04 | 0.02 |
| 129 (Present Invention) | " | 14 | −0.04 | 0.63 | 28.3 | 63 | 0.02 | 0.04 | 0.04 |

[1)]RHS value at yellow image density (fog + 0.3)
[2)]Value at magenta image 25 cycle/mm Tables 2 and 3 show that the samples of the present invention exhibit a high sensitivity, an excellent graininess represented by the RMS value, an excellent sharpness represented by MTF value, an excellent color reproducibility represented by the color stain value, and a high dye stability. Further, it is shown that the samples of the present invention exhibit a small change in the photographic properties under strict conditions between after exposure (picture taking) and before development. It is also shown that the incorporation of a compound represented by the general formula (A) and the increase in the monodispersibility of emulsion are preferred for sensitivity/graininess and the emulsion of the present invention can be used in admixture with other emulsions to exhibit excellent properties.

EXAMPLE 2

Sample 201 was prepared in the same manner as Sample 109 except that the emulsions to be incorporated in the 5th and 9th layers were replaced by Emulsion 9 and Coupler ExY-1 to be incorporated in the 4th, 7th, 8th, 11th and 12th layers were replaced by R-1 in the equimolecular amount.

Samples 202 to 211

Samples 202 to 211 were prepared in the same manner as Sample 201 except that R-1 was replaced by Comparative Couplers R-2 to R-6, and Couplers (2), (4), (6), (7) and (9) of the present invention, respectively. The added amount of these couplers were adjusted such that the resulting samples exhibit substantially the same sensitivity and gamma when subjected to imagewise exposure to white light and the following color development.

Samples 212 to 222

Samples 212 to 222 were prepared in the same manner as Samples 201 to 211, respectively, except that Emulsion 9 to be incorporated in the 5th, 9th and 12th layers were replaced by Emulsion 1.

These samples were imagewise exposed to green light, and then subjected to the following color development. The color stain value was determined by subtracting the yellow fog density at yellow density from the magenta density (fog+1.0). The results are set forth in Table 4.

Another batch of these samples were imagewise exposed to white light, allowed to stand at a temperature of 60° C. and a relative humidity of 60% for 14 days, irradiated with 20,000 lux light from a fluorescent lamp on the emulsion surface side for 7 days, and then measured for the sensitivity drop from the initial yellow density of 2.5.

RMS value at the magenta image density (fog+1.0) was also determined.

The color development was effected as follows:

| Step | Time | Temperature | Replenishment rate | Tank capacity |
|---|---|---|---|---|
| Color development | 2 min. 20 sec. | 40° C. | 25 ml | 10 l |
| Bleach | 45 sec. | 38° C. | 5 ml | 4 l |
| Blix (1) | 45 sec. | 38° C. | | 4 l |
| Blix (2) | 45 sec. | 38° C. | 30 ml | 4 l |
| Washing (1) | 20 sec. | 38° C. | | 2 l |
| Washing (2) | 20 sec. | 38° C. | 30 ml | 2 l |
| Stabilization | 20 sec. | 38° C. | 20 ml | 2 l |
| Drying | 1 min. | 55° C. | | |

* Determined per 35 mm width and 1 m length

The blix and washing step were effected in a countercurrent process wherein the solution flows backward. All of the overflow from the blix tank (1) was introduced into the blix tank (2).

The amount of the blix solution brought over to the washing step was 2 ml per m of 35 mm-wide light-sensitive material.

| | Running Solution | Replenisher |
|---|---|---|
| Color developer | | |
| Diethylenetriamine-pentaacetic acid | 5.0 g | 6.0 g |
| Sodium sulfite | 4.0 g | 5.0 g |
| Potassium carbonate | 30.0 g | 37.0 g |
| Potassium bromide | 1.3 g | 0.5 g |
| Potassium iodide | 1.2 mg | — |
| Hydroxylamine sulfate | 2.0 g | 3.6 g |
| 4-[N-ethyl-N-β-hydroxyethylamino]-2-methylaniline sulfate | 4.7 g | 6.2 g |
| Water to make | 1.0 l | 1.0 l |
| pH | 10.00 | 10.15 |
| Bleaching solution | | |
| Ferric ammonium 1,3-propylenediaminetetraacetate monohydrate | 144.0 g | 206.0 g |
| 1,3-Diaminopropanetetraacetic acid | 2.8 | 4.0 |
| Ammonium bromide | 84.0 g | 120.0 g |
| Ammonium nitrate | 17.5 g | 25.0 g |
| 27% Aqueous ammonia | 10.0 g | 1.8 g |
| 98% Acetic acid | 51.1 g | 73.0 g |
| Water to make | 1.0 l | 1.0 l |
| pH | 4.3 | 3.4 |
| Blix solution (running solution) | | |
| Ferric ammonium ethylenediaminetetraacetate dehydrate | 50.0 g | |
| Disodium ethylenediaminetetraacetate | 5.0 g | 25.0 g |
| Sodium sulfite | 12.0 g | 20.0 g |
| 700 g/l Aqueous solution of ammonium thiosulfate | 290.0 ml | 320.0 ml |
| 27% Aqueous ammonia | 6.0 ml | 15.0 ml |
| Water to make | 1.0 l | 1.0 l |
| pH | 6.8 | 8.0 |

Washing Solution (The running solution was also used as replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to7.5.

| Stabilizing solution | Running Solution | Replenisher |
|---|---|---|
| 37% Formalin | 1.2 ml | Same as left |
| Surface active agent $[C_{10}H_{21}—O—(CH_2CH_2O)_{10}—H]$ | 0.4 g | do. |
| Ethylene glycol | 1.0 g | do. |
| Water to make | 1.0 l | do. |
| pH | 5.0–7.0 | do. |

TABLE 4

| Sample | Emulsion incorporated in 5th, 9th, 12th layers | Coupler incorporated in 4th, 7th, 8th, 11th, 12th layers Type | Amount | RMS value × 1000 | Color stain value | Dye stability (density drop) 60° C., 70% | Fluorescent lamp |
|---|---|---|---|---|---|---|---|
| 201 (Comparative) | 9 | R-1 | 1.0 | 12.8 | 0.07 | 0.24 | 0.23 |
| 202 (Comparative) | " | R-2 | 2.5 | 13.1 | 0.15 | 0.25 | 0.16 |
| 203 (Comparative) | " | R-3 | 1.2 | 12.9 | 0.17 | 0.20 | 0.16 |
| 204 (Comparative) | " | R-4 | 1.0 | 12.8 | 0.13 | 0.15 | 0.12 |
| 205 (Comparative) | " | R-5 | 1.0 | 12.8 | 0.09 | 0.19 | 0.16 |

TABLE 4-continued

| Sample | Emulsion incorporated in 5th, 9th, 12th layers | Coupler incorporated in 4th, 7th, 8th, 11th, 12th layers Type | Amount | RMS value × 1000 | Color stain value | Dye stability (density drop) 60° C., 70% | Fluorescent lamp |
|---|---|---|---|---|---|---|---|
| 206 (Comparative) | " | R-6 | 1.0 | 12.7 | 10.07 | 0.30 | 0.25 |
| 207 (Comparative) | " | (2) | 1.0 | 12.3 | 0.06 | 0.08 | 0.04 |
| 208 (Comparative) | " | (4) | 1.2 | 12.3 | 0.07 | 0.06 | 0.04 |
| 209 (Comparative) | " | (6) | 1.5 | 12.4 | 0.07 | 0.06 | 0.04 |
| 210 (Comparative) | " | (7) | 1.5 | 12.4 | 0.07 | 0.07 | 0.04 |
| 211 (Comparative) | " | (9) | 1.7 | 12.5 | 0.08 | 0.07 | 0.04 |
| 212 (Comparative) | 1 | R-1 | 1.0 | 11.1 | 0.05 | 0.23 | 0.20 |
| 213 (Comparative) | " | R-2 | 2.5 | 11.3 | 0.13 | 0.24 | 0.21 |
| 214 (Comparative) | " | R-3 | 1.2 | 11.2 | 0.16 | 0.19 | 0.15 |
| 215 (Comparative) | 1 | R-4 | 1.0 | 11.1 | 0.12 | 0.15 | 0.12 |
| 216 (Comparative) | " | R-5 | 1.0 | 11.1 | 0.07 | 0.18 | 0.15 |
| 217 (Comparative) | " | R-6 | 1.0 | 11.0 | 0.06 | 0.28 | 0.23 |
| 218 (Present Invention) | " | (2) | 1.0 | 10.7 | 0.04 | 0.08 | 0.04 |
| 219 (Present Invention) | " | (4) | 1.2 | 10.7 | 0.05 | 0.06 | 0.04 |
| 220 (Present Invention) | " | (6) | 1.5 | 10.8 | 0.05 | 0.06 | 0.04 |
| 221 (Present Invention) | " | (7) | 1.5 | 10.8 | 0.06 | 0.06 | 0.04 |
| 222 (Present Invention) | " | (9) | 1.7 | 10.9 | 0.07 | 0.07 | 0.04 |

Table 4 shows that the samples of the present invention exhibit an excellent graininess, an excellent color reproducibility represented by color stain value and a high dye stability.

EXAMPLE 3

Samples 301 to 309 were prepared in the same manner as Sample 212 except that ExY-3 to be incorporated in the 11th and 12th layers were replaced by Couplers (1), (3), (5), (8), (10), (13), (14), (25) and (29), respectively, in the equimolecular amount. These samples were developed in the same manner as in Example 1. As a result, these samples exhibited an excellent color reproducibility, an excellent graininess and a high dye stability.

EXAMPLE 4

Samples 401 to 403 were prepared in the same manner as Sample 311 of JP-A-2-28637 except that ExY-2 to be incorporated in the 7th and 12th layers was replaced by Couplers (2), (4) and (6) of the present invention in the amount of 0.5 molar times and ExY-1 to be incorporated in the 11th, 12th and 13th layers was replaced by Coupler (44) of the present invention in the equimolecular amount, respectively (Emulsions M and Q correspond to the emulsions of the present invention). These samples were evaluated in the same manner as in Example 1. It was confirmed that Samples 401 to 403 exhibit excellent graininess, color reproducibility, sharpness and dye preservability and a reduced fog fluctuation during the storage of the light-sensitive material as compared to Sample 311 of JP-A-2-28637.

The compounds used are set forth below:

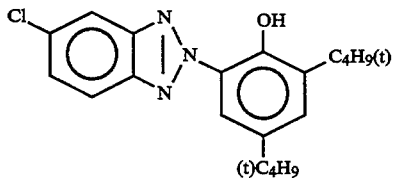

UV-1

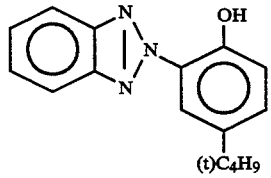

UV-2

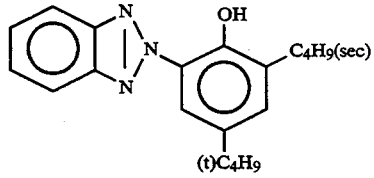

UV-3

-continued
UV-4
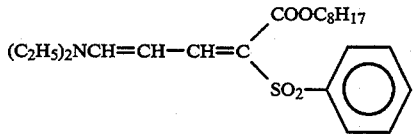
ExF-1
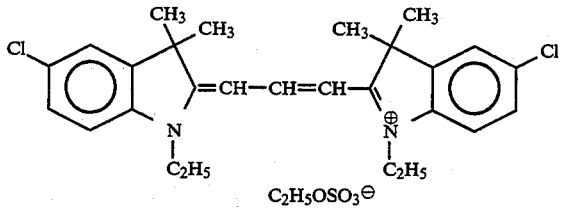
ExC-1
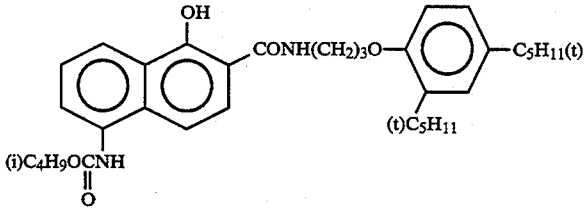
ExC-2
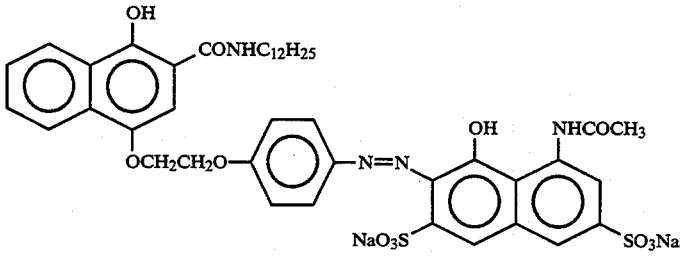
ExC-3
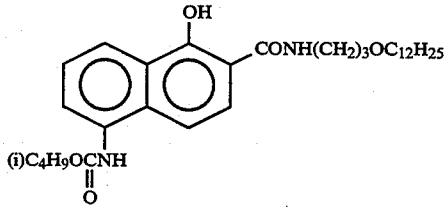
ExC-4
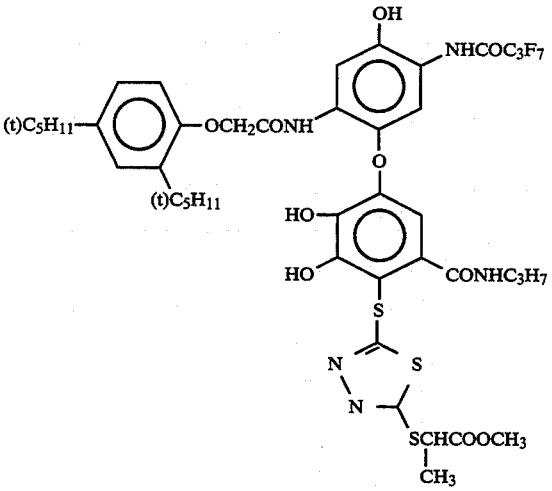

-continued
ExC-5
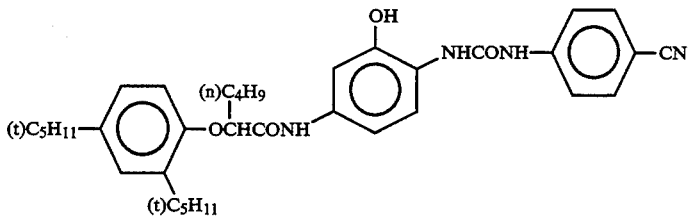
ExC-6
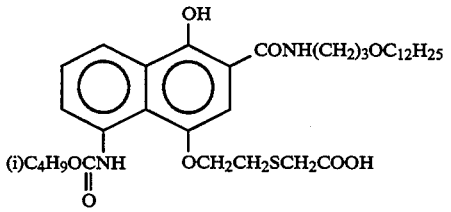
ExC-7
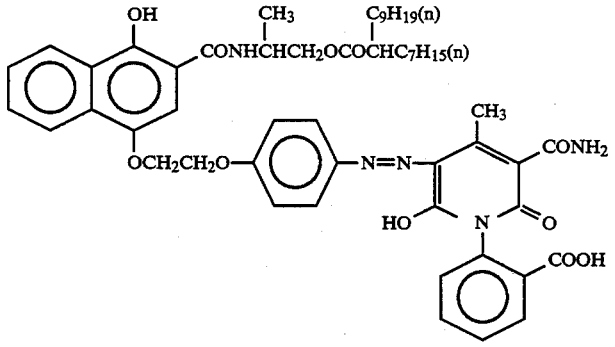
ExM-1
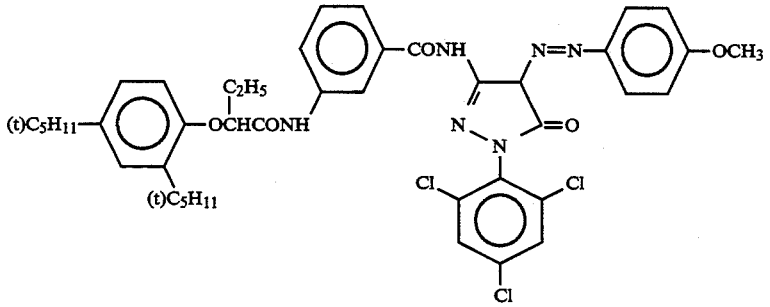
ExM-2
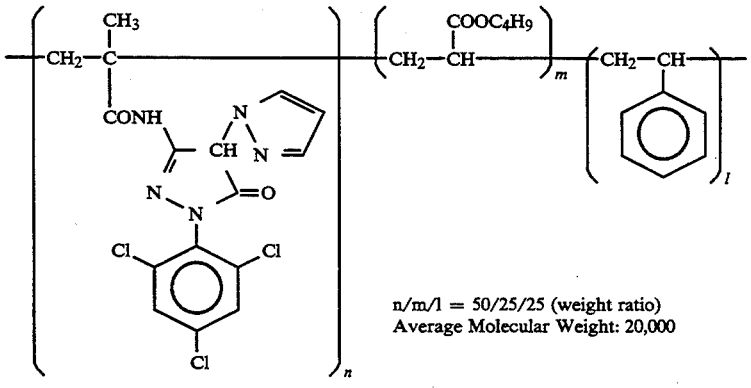
n/m/l = 50/25/25 (weight ratio)
Average Molecular Weight: 20,000

-continued
ExM-3
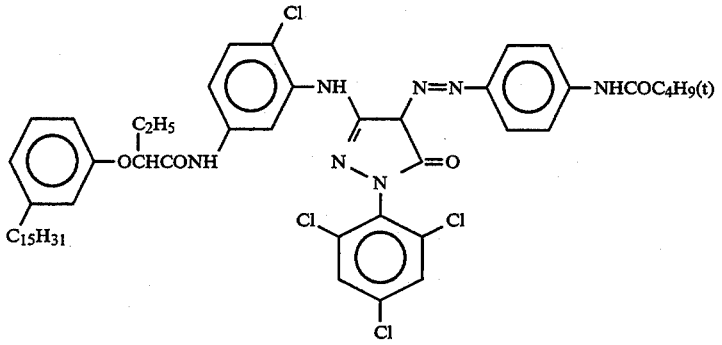
ExM-4
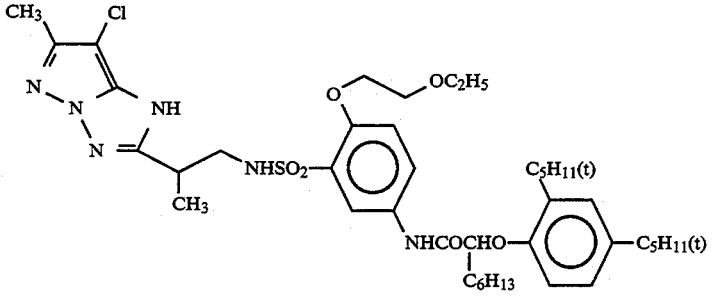
ExM-5
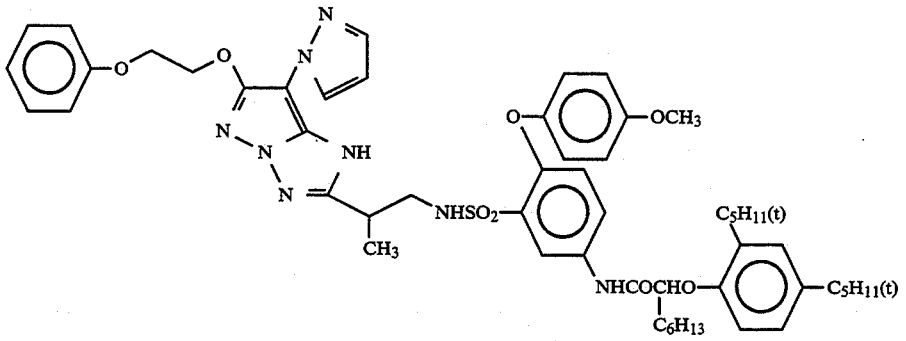
(Coupler similar to the coupler disclosed in U.S. Pat. No. 3,377,563)
ExY-1
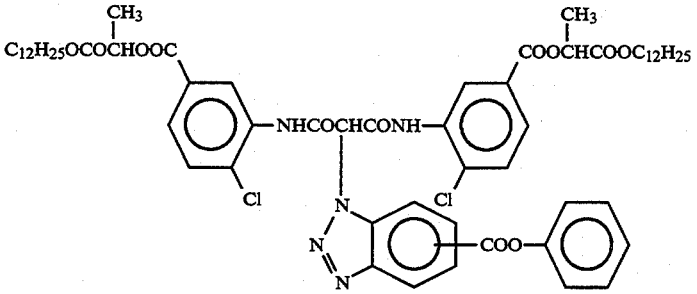
ExY-2
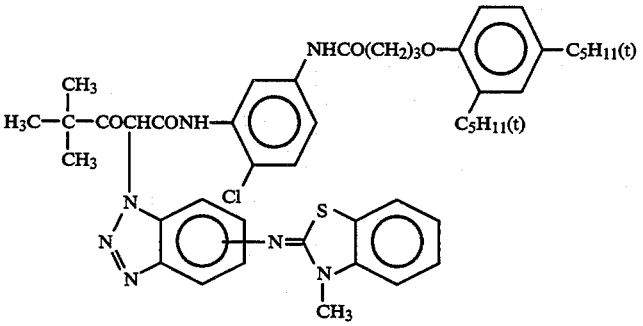

-continued
(Compound 1 described in Research Disclosure No. 18053)
ExY-3
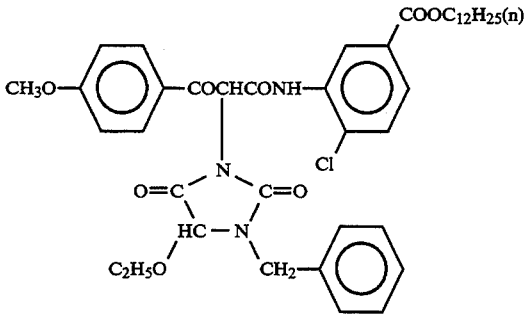
Cpd-1
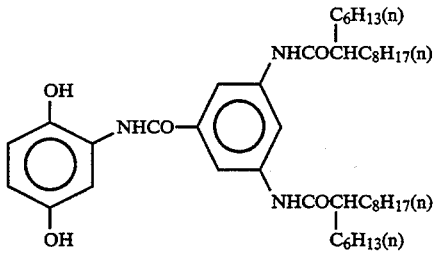
Cpd-2
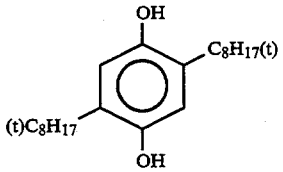
Cpd-3
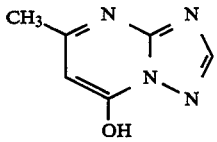
Cpd-4
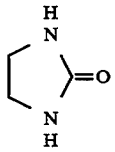
Cpd-5
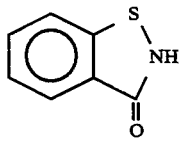
Cpd-6
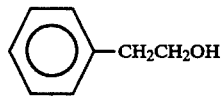
Cpd-7
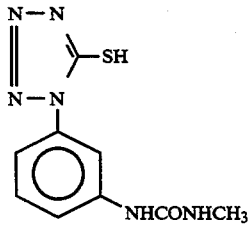

-continued
Cpd-8
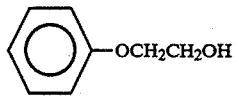
Cpd-9
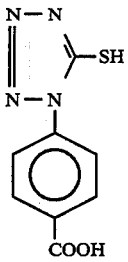
Cpd-10
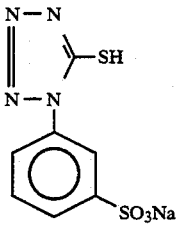
Cpd-11
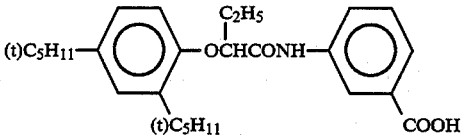
ExS-1
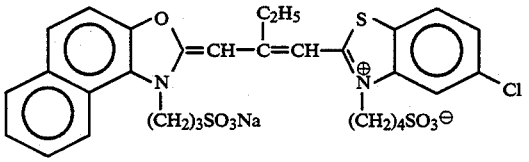
ExS-2
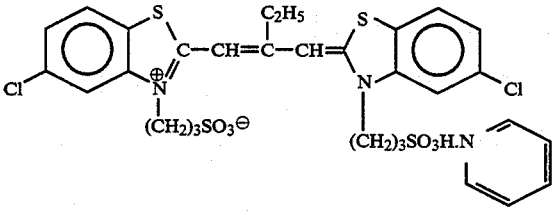
ExS-3
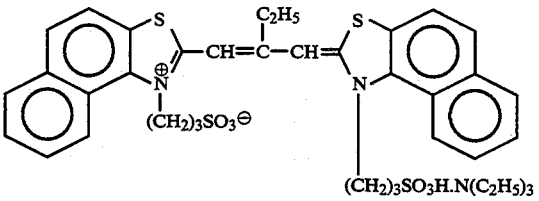
ExS-4
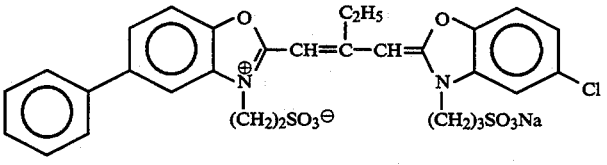

-continued
ExS-5
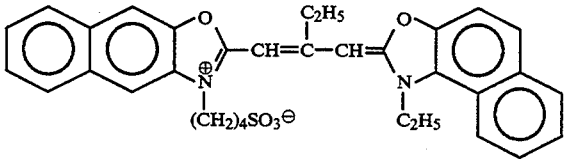
ExS-6
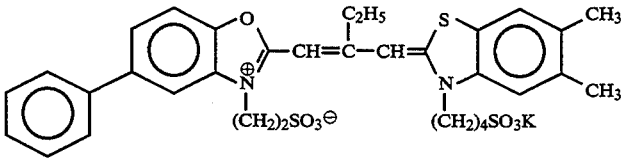
ExS-7
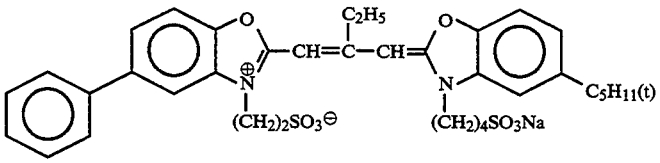
ExS-8
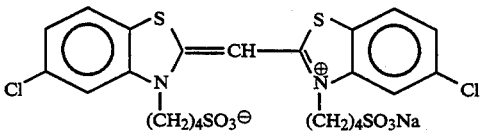
B-1
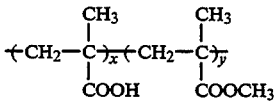
x/y = 10/90
B-2
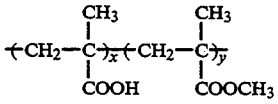
x/y = 40/60
B-3
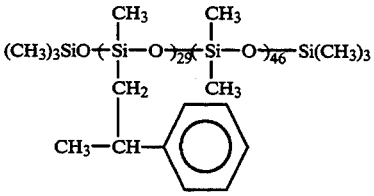
B-4
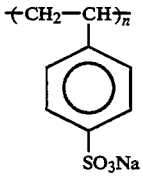
H-1
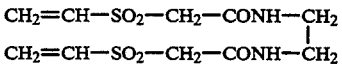
W-1
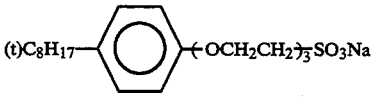
W-2
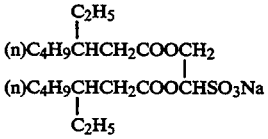

-continued
$C_8F_{17}SO_2N(C_3H_7)CH_2COOK$ W-3
Copolymer of vinyl pyrrolidone and vinyl alcohol (copolymerization ratio = 70:30 by weight) P-1
Polyethyl acrylate P-2
F-1
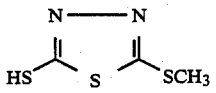
F-4
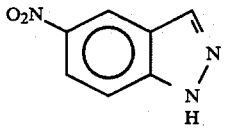
F-5
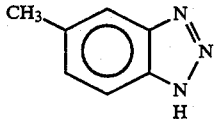
F-6
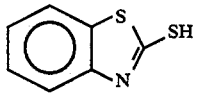
F-7
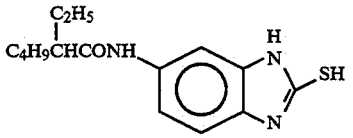
F-8
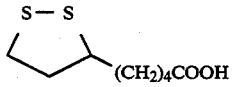
F-9
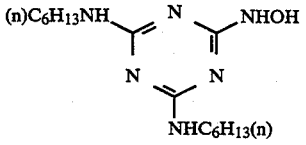
F-10
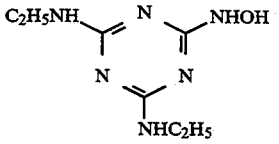
F-11
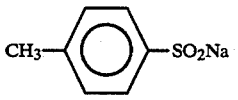
(Coupler (16) disclosed in U.S. Pat. No. 4,477,563) R-1
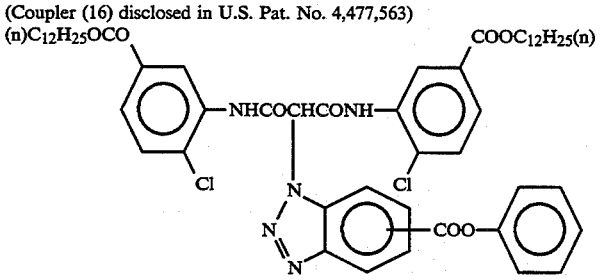

-continued (Coupler similar to the coupler disclosed in U.S. Pat. No. 4,149,886 and British Patent 1,204,680)

R-2

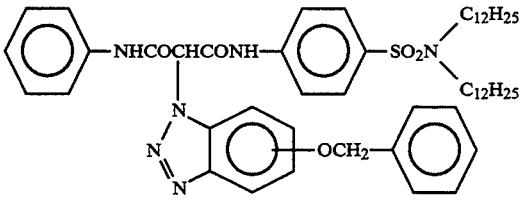

(Coupler similar to Coupler (40) disclosed in U.S. Pat. No. 3,632,345)

R-3

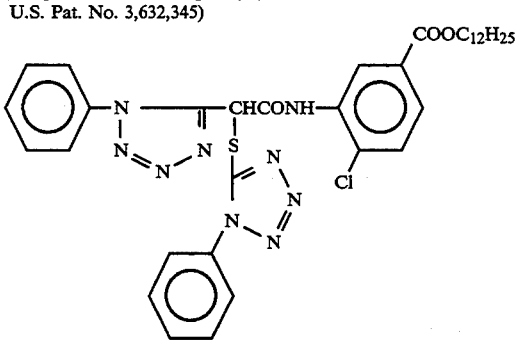

(Coupler disclosed in JP-A-63-261262)

R-4

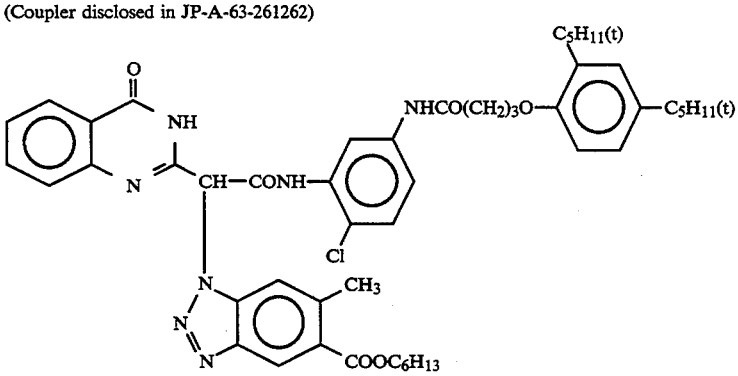

(Coupler disclosed in JP-A-2-28645)

R-5

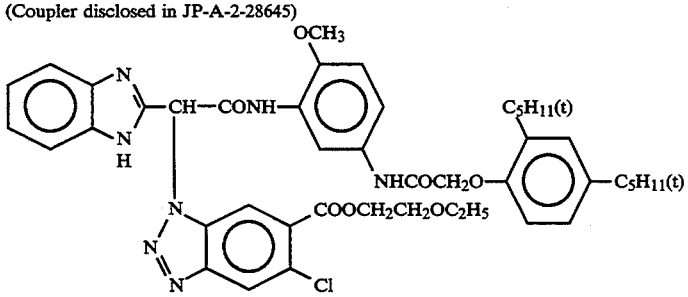

(Coupler disclosed in JP-A-2-2552)

R-6

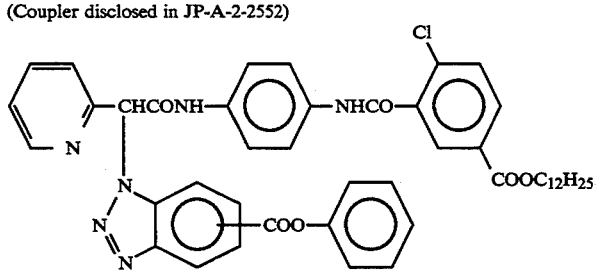

Solv-1: Tricresyl phosphate
Solv-2: Dibutyl phthalate
Solv-3: Tri(2-ethylhexyl) phosphate The silver halide color photographic material of the present invention has the following remarkable features:

(a) High sensitivity and excellent graininess, color reproducibility and sharpness;
(b) Excellent yellow image preservability;
(c) Reduced fluctuation in photographic properties during storage; and
(d) Low cost and excellent image quality.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one light-sensitive emulsion layer containing a coupler represented by the general formula (II), silver iodobromide containing 15 to 45 mol % silver iodide in a definite layer structure in said emulsion layer, and chemically sensitized silver halide grains having a total silver iodide content of more than 7 mol %:

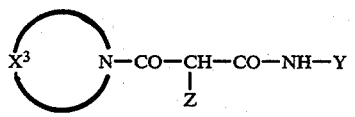

(II)

wherein $X^3$ represents an organic residue which forms a nitrogen-containing heterocyclic group together with >N—; Y represents an aryl group or a heterocyclic group; and Z represents a group capable of being cleaved from the coupler upon the reaction of the coupler with the oxidation product of a developing agent.

2. The silver halide color photographic material as claimed in claim 1, wherein said photographic material contains a compound represented by the general formula (A):

$$Q-SM^1 \quad (A)$$

wherein Q represents a heterocyclic group comprising at least one of $-SO_3M^2$, $-COOM^2$, —OH and $-NR^1R^2$ directly or indirectly connected thereto; $M^1$ and $M^2$ each independently represents a hydrogen atom, an alkaline metal, a quaternary ammonium or a quaternary phosphonium; and $R^1$ and $R^2$ each represents a hydrogen atom or an alkyl group.

3. The silver halide color photographic material as claimed in claim 1, wherein said silver halide grain emulsion is a monodisperse emulsion having a grain diameter variation coefficient of 0.25 or less.

4. The silver halide color photographic material as claimed in claim 2, wherein the compound represented by formula (A) is represented by formulae (B) or (C):

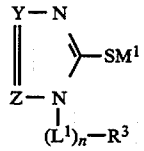

(B)

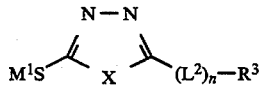

(C)

wherein in the general formula (B), Y and Z each independently represents a nitrogen atom or $CR^4$ in which $R^4$ represents a hydrogen atom, a substituted or unsubstituted alkyl group or a substituted or unsubstituted aryl group; $R^3$ represents an organic residue substituted by at least one selected from the group consisting of $-SO_3M^2$, $-COOM^2$, —OH and $-NR^1R^2$ wherein $M^1$ and $M^2$ each independently represents a hydrogen atom, an alkaline metal, a quaternary ammonium or a quaternary phosphonium, and $R^1$ and $R^2$ each represents a hydrogen atom or a substituted or unsubstituted alkyl group; $L^1$ represents a linking group selected from the group consisting of —S—, —O—, —N—, —CO—, —SO— and $-SO_2-$; and n represents an integer 0 to 1.

5. The silver halide color photographic material as claimed in claim 2, wherein two or more kinds of said silver halide grains or said silver halide grains and silver halide grains not corresponding thereto are contained in the same light-sensitive layer.

6. The silver halide color photographic material as claimed in claim 3, wherein two or more kinds of said silver halide grains or said silver halide grains and silver halide grains not corresponding thereto are contained in the same light-sensitive layer.

7. The silver halide color photographic material as claimed in claim 1, wherein two or more kinds of said silver halide grains or said silver halide grains and silver halide grains not corresponding thereto are contained in the same light-sensitive layer.

8. The silver halide color photographic material as claimed in claim 1, wherein the heterocyclic group represented by Y has 1 to 20 carbon atoms and contains at least one nitrogen, oxygen or sulfur atom as a hetero atom.

9. The silver halide color photographic material as claimed in claim 1, wherein when $X^3$ forms a substituted nitrogen containing heterocyclic group together with >N—, the substituents are selected from the group consisting of an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group and an aryl group.

10. The silver halide color photographic material as claimed in claim 1, wherein Y is an aryl group having 6 to 20 carbon atoms.

11. The silver halide color photographic material as claimed in claim 1, wherein when Y represents a substituted aryl group or a substituted heterocyclic group, the substituents are selected from the group consisting of an alkoxy group, a halogen atom, an alkoxycarbonyl group, an acyloxy group, an acylamino group, a sulfonyl group a carbamoyl group, a sulfamoyl group, a sulfonamido group, a nitro group, an alkyl group and an aryl group.

12. The silver halide color photographic material as claimed in claim 1, wherein Y is a phenyl group containing at least one substituent in the ortho position.

13. The silver halide color photographic material as claimed in claim 1, wherein the couplers represented by formula (II) are represented by general formulae (IV) and (V):

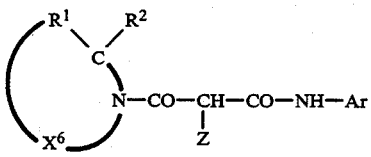

(IV)

-continued (V)

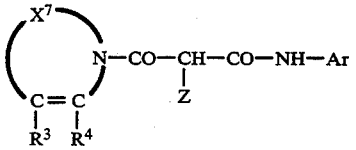

wherein Z is as defined in the general formula (I); Ar represents a phenyl group containing at least one substituent in the ortho position thereof; $X^6$ represents an organic residue which forms a nitrogen containing heterocyclic group (monocyclic or condensed) together with —C($R^1R^2$)—N<; $X^7$ represents an organic residue which forms a nitrogen containing heterocyclic group (monocyclic or condensed ring) together with —C($R^3$)=C($R^4$)—N<; and $R^1$, $R^2$, $R^3$ and $R^4$ each represents a hydrogen atom or a substituent.

14. The silver halide color photographic material as claimed in claim 1, wherein the total amount of the coupler of formula (II) to be incorporated in the light-sensitive material is, if Z contains a photographically useful component, in the range of 0.001 to 0.80 g/m$^2$, or if not, in the range of 0.001 to 1.20 g/m$^2$.

* * * * *